US010508876B2

(12) United States Patent
Alicea, Jr.

(10) Patent No.: US 10,508,876 B2
(45) **Date of Patent: *Dec. 17, 2019**

(54) OPERATING MODE SELECTION MECHANISM AND METHOD FOR A FIREARM

(71) Applicant: Benjamin Alicea, Jr., Oldsmar, FL (US)

(72) Inventor: Benjamin Alicea, Jr., Oldsmar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/031,109

(22) Filed: Jul. 10, 2018

(65) Prior Publication Data

US 2018/0321007 A1 Nov. 8, 2018

Related U.S. Application Data

(63) Continuation of application No. 15/385,092, filed on Dec. 20, 2016, now Pat. No. 10,030,928, which is a continuation of application No. 14/865,613, filed on Sep. 25, 2015, now Pat. No. 9,658,017.

(51) Int. Cl.

| | |
|---|---|
| ***F41A 19/59*** | (2006.01) |
| ***F41A 17/56*** | (2006.01) |
| ***F41A 19/69*** | (2006.01) |
| ***F41A 19/10*** | (2006.01) |

(52) U.S. Cl.

CPC ..... *F41A 19/59* (2013.01); *F41A 17/56* (2013.01); *F41A 19/10* (2013.01); *F41A 19/69* (2013.01)

(58) Field of Classification Search

CPC ..... F41A 17/56; F41A 19/58; F41A 19/64; F41A 19/65; F41A 19/66; F41A 19/67; F41A 19/69

USPC ..... 89/128, 132, 135, 139, 140, 142, 144, 89/148, 149, 150, 154

See application file for complete search history.

(56) References Cited

U.S. PATENT DOCUMENTS

| | | | |
|---|---|---|---|
| 2,780,882 | A | 2/1957 | Temple |
| 3,045,555 | A | 7/1962 | Stoner |
| 3,301,133 | A | 1/1967 | Sturtevant |
| 3,442,173 | A | 5/1969 | Muller |
| 4,727,670 | A | 3/1988 | Krouse |
| 4,793,085 | A | 12/1988 | Surawski et al. |
| 5,251,533 | A | 10/1993 | Layton |
| 5,465,518 | A | 11/1995 | Blaser |
| 5,713,150 | A | 2/1998 | Ealovega |
| 5,727,538 | A | 3/1998 | Ellis |
| 6,412,207 | B1 | 7/2002 | Crye et al. |
| 6,442,880 | B1 | 9/2002 | Allan |
| 6,615,527 | B1 | 9/2003 | Martin |
| 6,626,165 | B1 | 9/2003 | Styles et al. |
| 6,976,416 | B2 | 12/2005 | Ealovega |
| 7,765,999 | B1 | 8/2010 | Stephens et al. |
| 7,819,051 | B1 | 10/2010 | Beckmann et al. |

(Continued)

*Primary Examiner* — Bret Hayes

(74) *Attorney, Agent, or Firm* — Taft Stettinius & Hollister LLP

(57) ABSTRACT

There is disclosed herein systems, methods and apparatus relating to a selective fire firearm. A firing mechanism is provided for mechanically and electronically firing a firearm depending on the operating mode selected by the user. A selector mechanism allows for selection of a safety mode of operation, a semi-automatic firing mode of operation, an automatic firing mode of operation, and an electronic firing mode of operation.

19 Claims, 19 Drawing Sheets

(56) References Cited

U.S. PATENT DOCUMENTS

| | | | |
|---|---|---|---|
| 8,336,438 | B2 | 12/2012 | Compton et al. |
| 8,667,881 | B1 | 3/2014 | Hawbaker |
| 8,807,007 | B2 | 8/2014 | Alicea |
| 9,151,559 | B2 | 10/2015 | Alicea, Jr. |
| 9,551,546 | B2 | 1/2017 | Alicea |
| 9,658,017 | B2 | 5/2017 | Alicea |
| 10,030,928 | B2 * | 7/2018 | Alicea, Jr. ..... F41A 19/59 |
| 2006/0169268 | A1 | 8/2006 | Tippmann |
| 2009/0255160 | A1 | 10/2009 | Summers |
| 2010/0186277 | A1 | 7/2010 | Beckman |
| 2011/0061280 | A1 | 3/2011 | Emde |
| 2011/0232618 | A1 | 9/2011 | Gabrel |
| 2013/0019510 | A1 | 1/2013 | Kemmerer |
| 2013/0019512 | A1 | 1/2013 | Kemmerer |
| 2013/0125441 | A1 | 5/2013 | Westwood |
| 2013/0167423 | A1 | 7/2013 | Lupher |
| 2013/0180147 | A1 | 7/2013 | Lupher |
| 2016/0018176 | A1 | 1/2016 | Fellows et al. |
| 2017/0122686 | A1 | 5/2017 | Fellows et al. |

* cited by examiner

OPERATING MODE SELECTION MECHANISM AND METHOD FOR A FIREARM

CROSS-REFERENCE TO RELATED APPLICATION

The present application is a continuation of U.S. patent application Ser. No. 15/385,092 filed Dec. 20, 2016, and now issued as U.S. Pat. No. 10,030,928, which is a continuation of U.S. patent application Ser. No. 14/865,613 filed on Sep. 25, 2015, and now issued as U.S. Pat. No. 9,658,017, which are incorporated herein by reference.

BACKGROUND

Firearms typically rely on mechanical systems to control the firing of projectiles from the firearm. Firearms that are selective fire weapons employ multiple operating modes, such as automatic firing modes, semi-automatic firing modes and safety modes. These selective fire weapons, including M-16, M-4, AK-47 and other similar firearms, have complex mechanical systems associate with the trigger group and operating mode selection to make the selective fire capability available.

In some firearms, there is provided an electronic firing mode, such as disclosed in U.S. Pat. No. 8,807,007 to the present inventor, which patent is incorporated herein by reference in its entirety for all purposes. However, a firearm with such an electronic firing mode has not heretofore incorporated, in addition to the electronic firing mode, a safety mode and multiple mechanical firing modes.

Firearms with electronic systems present an opportunity to provide a more versatile and useful weapon for military and law enforcement, particularly when implemented with those selective fire weapons that already employ multiple mechanical firing modes. However, selective fire weapons have not integrated electronic firing systems and operating mode selection systems that retain the multiple mechanical firing modes and safety mode while incorporating an electronic firing system with an existing weapon platform. Therefore, further improvements in this area are needed.

SUMMARY

There is disclosed herein systems, methods and apparatus relating to a selective fire firearm with a safety mode to prevent firing and multiple mechanical firing modes and an electronic firing mode with an electronically operable firing system to fire projectiles from the selective fire firearm. In one embodiment, the systems, methods and apparatus include an operating mode selection mechanism that allows the user to select the desired operating mode and that also configures the selective fire firearm to operate in the desired operating mode. In another embodiment, the operating mode selection mechanism is mechanically linked to a electronic firing mode activation switch so the electronic firing mode is enabled when the electronic firing mode is selected.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION THE ILLUSTRATED EMBODIMENTS

Figure 1:
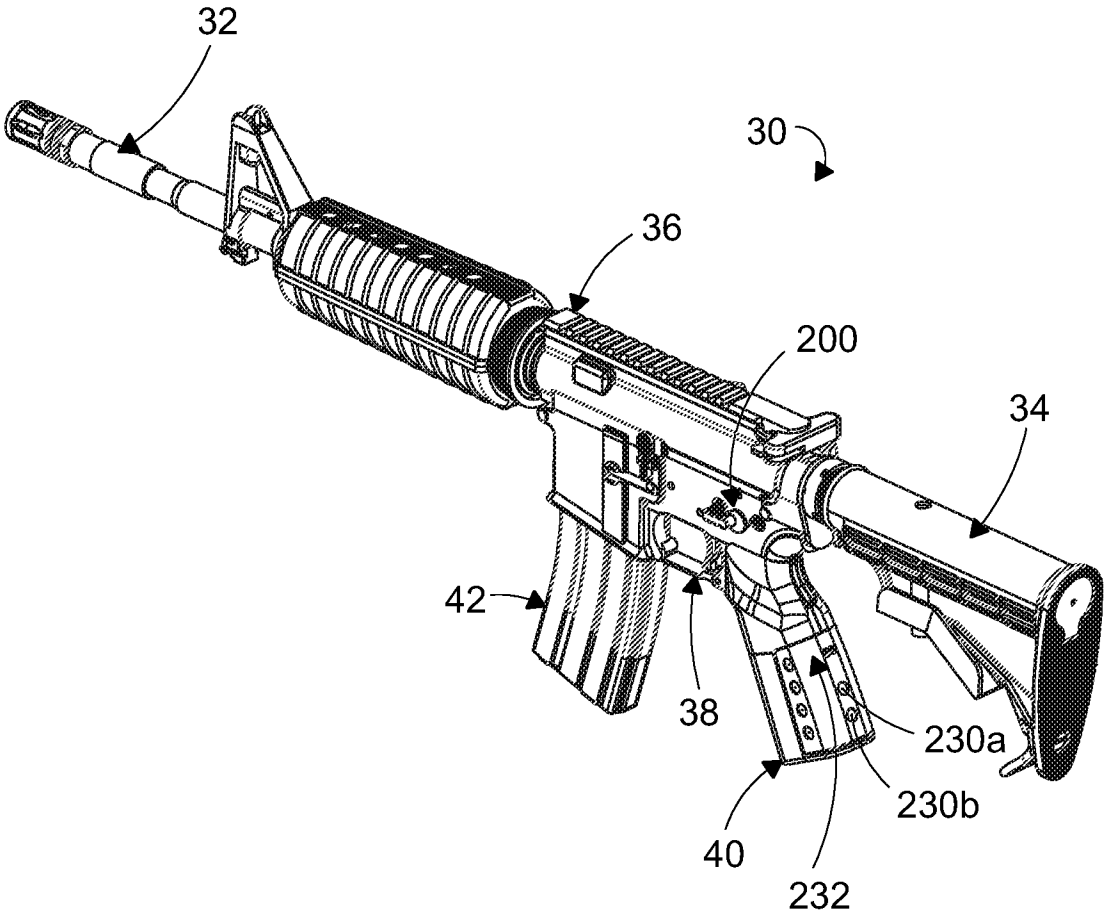
FIG. 1 is a perspective view of one embodiment of a selective fire firearm.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1, there is shown a selection fire weapon 30 that includes a barrel 32, a butt stock 34, an upper receiver 36, and a lower receiver 38. Selective fire firearm 30 also includes a grip assembly 40 and a magazine 42 secured to lower receiver 38. It should be understood that not all details of selective fire firearm 30 are shown and/or described, it being understood that the present disclosure has application to any firearm that is a selective fire type weapon, including an M-16, M-4 or AK-47 type firearms.

Figure 2:
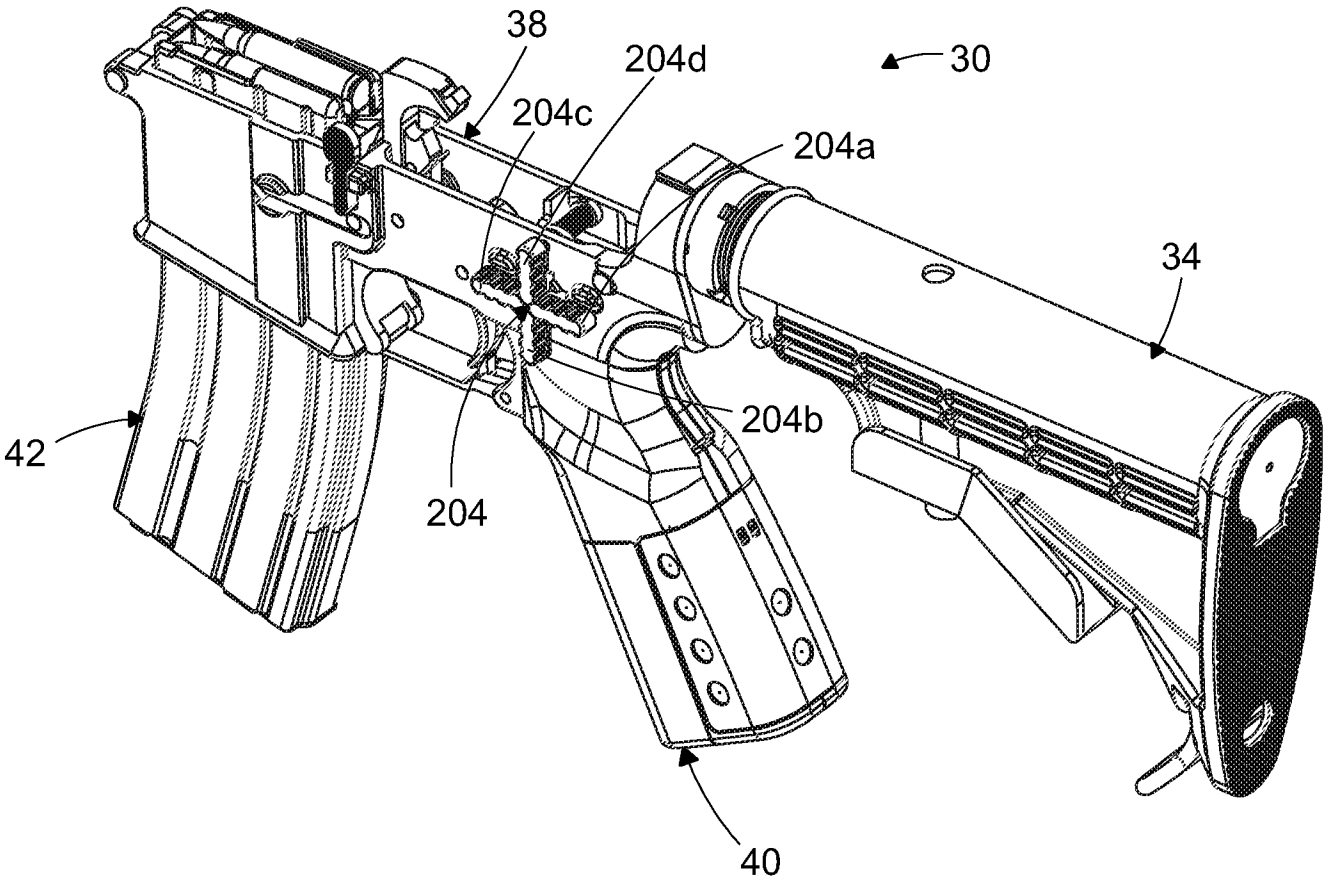
FIG. 2 is a perspective view of the selective fire firearm of FIG. 1 with the upper receiver and barrel removed.
Figure 3:
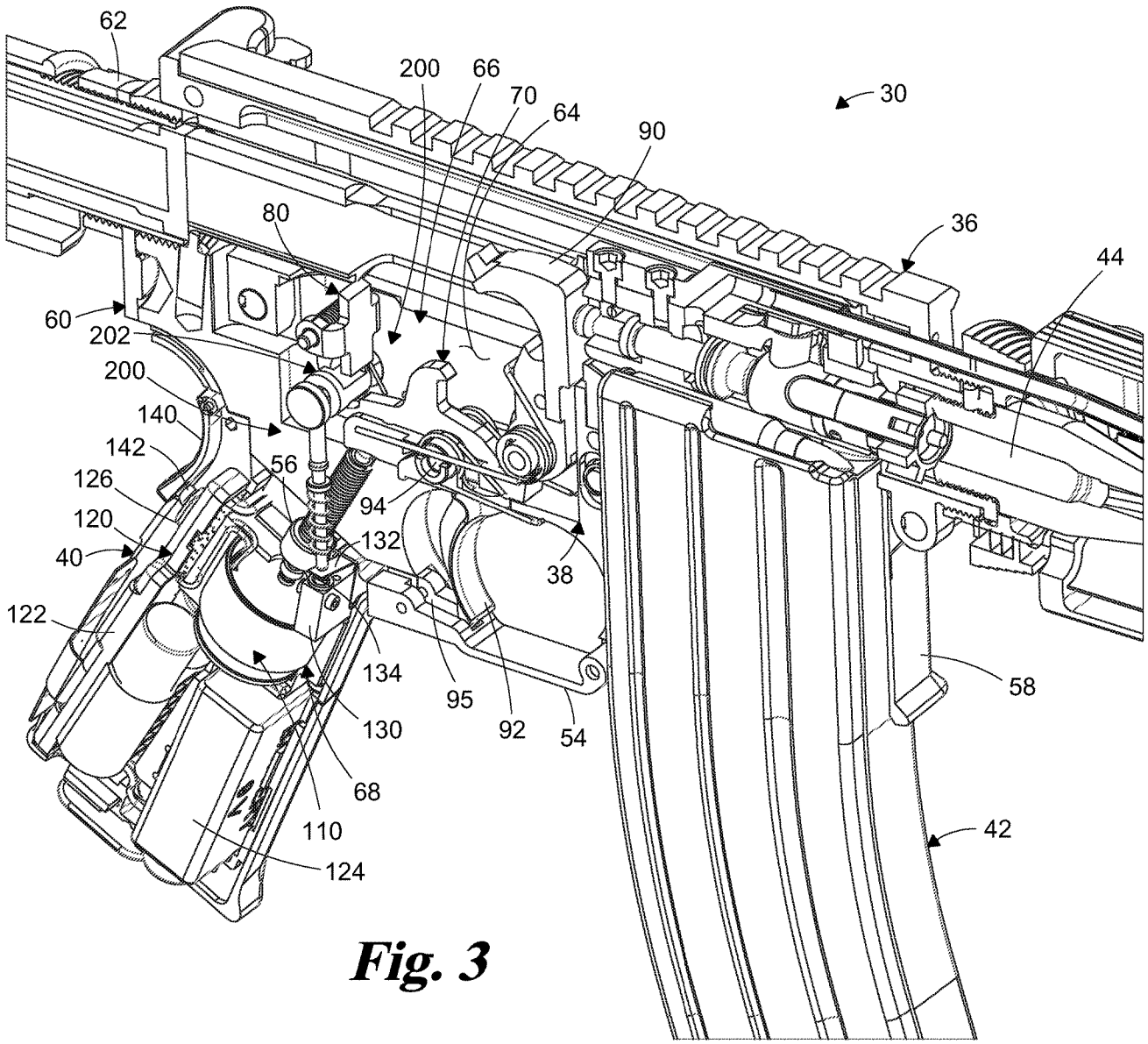
FIG. 3 is a perspective cutaway view of a lower receiver/grip assembly of the selective fire firearm of FIG. 1.

Referring to FIGS. 2-3, selective fire firearm 30 further includes a mechanical firing system 66 generally associated with lower receiver 38 and an electronic firing system 68 generally associated with grip assembly 40. As discussed further below, electronic firing system 68 is structured to selectively interface with and operate mechanical firing system 66 in an electronic firing mode of selective fire firearm 30. Selective fire firearm 30 includes a selector mechanism 200 that includes a mode selector 204 that is movable between four positions that each define and configure selective fire firearm 30 in a corresponding operating mode. The predefined positions for mode selector 204 include: a safety mode position 204*a*, a semi-automatic firing mode position 204*b*, an automatic firing mode position 204*c*, and an electronic firing mode position 204*d*. As used herein, an automatic firing mode includes a fully automatic firing mode in which a single pull continuously fires rounds until the trigger is released or the ammunition is depleted, and a burst firing mode in which more than one round but less than all the available rounds are fired in a single trigger pull, such as a three shot burst.

Figure 4:
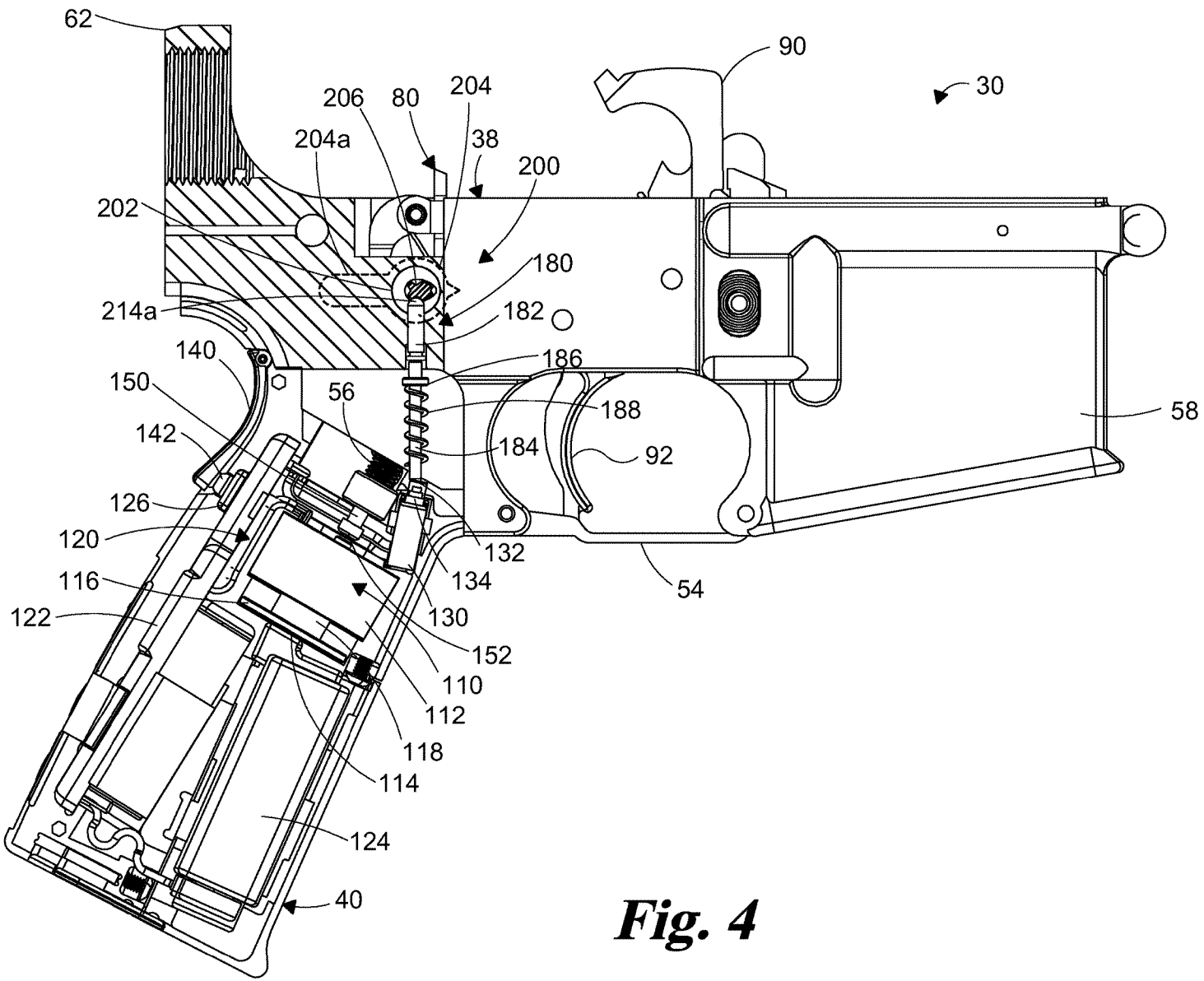
FIG. 4 is a side elevation cutaway view of the lower receiver/grip assembly of FIG. 3 with the operating mode selection mechanism in a safety position.

Lower receiver 38 includes a magazine holder 58 for receiving magazine 42 and a housing 60 with a buffer tube or stock assembly attachment member 62 at a rearward end thereof. Housing 60 defines a compartment 64 for housing at least a portion of mechanical firing system 66, such as a sear assembly 70, an auto sear 80, and a hammer 90. A trigger 92 is coupled to sear assembly 70 with a pin arrangement 94, which also couples sear assembly 70 to lower receiver 38. Hammer 90 is movable between a cocked position, such as shown in FIG. 5, to a released position by pulling of trigger 92, such as shown in FIGS. 2-4.

Figure 5:
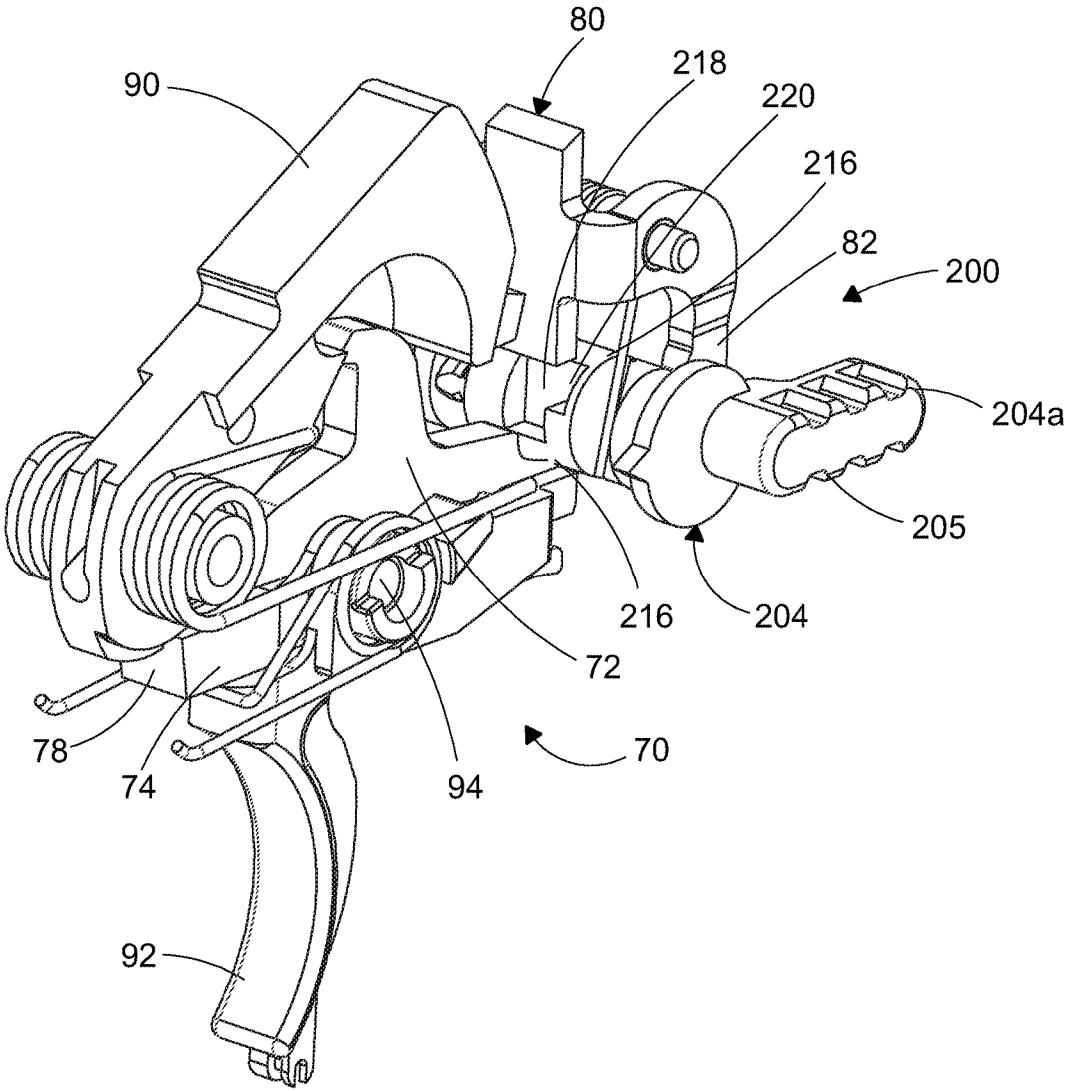
FIG. 5 is a perspective view of a trigger group from the lower receiver/grip assembly of FIG. 4 showing the operating mode selection mechanism in the safety position.
Figure 6:
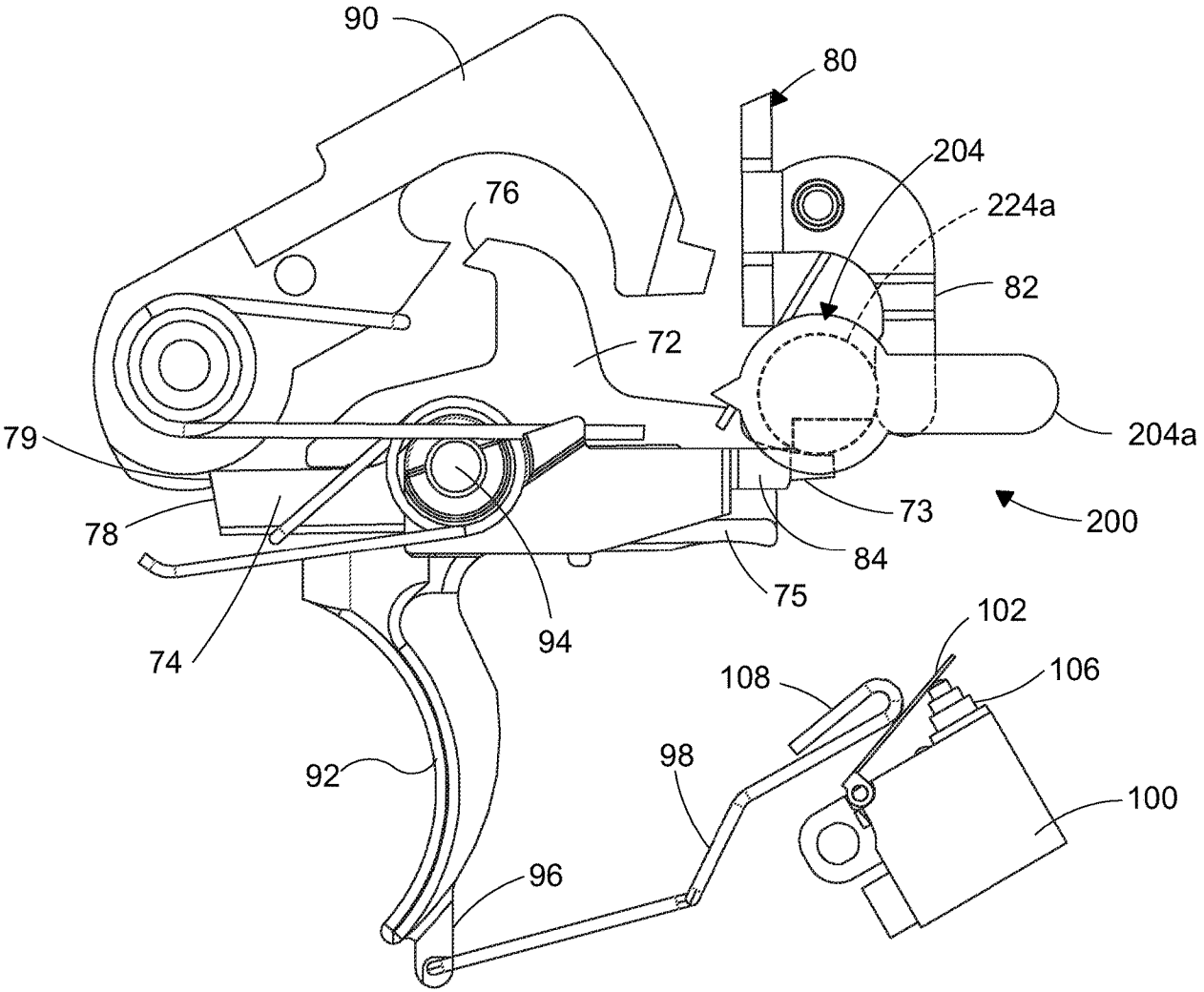
FIG. 6 is a side elevation of the trigger group and operating mode selection mechanism of FIG. 4 in the safety position.
Figure 7:
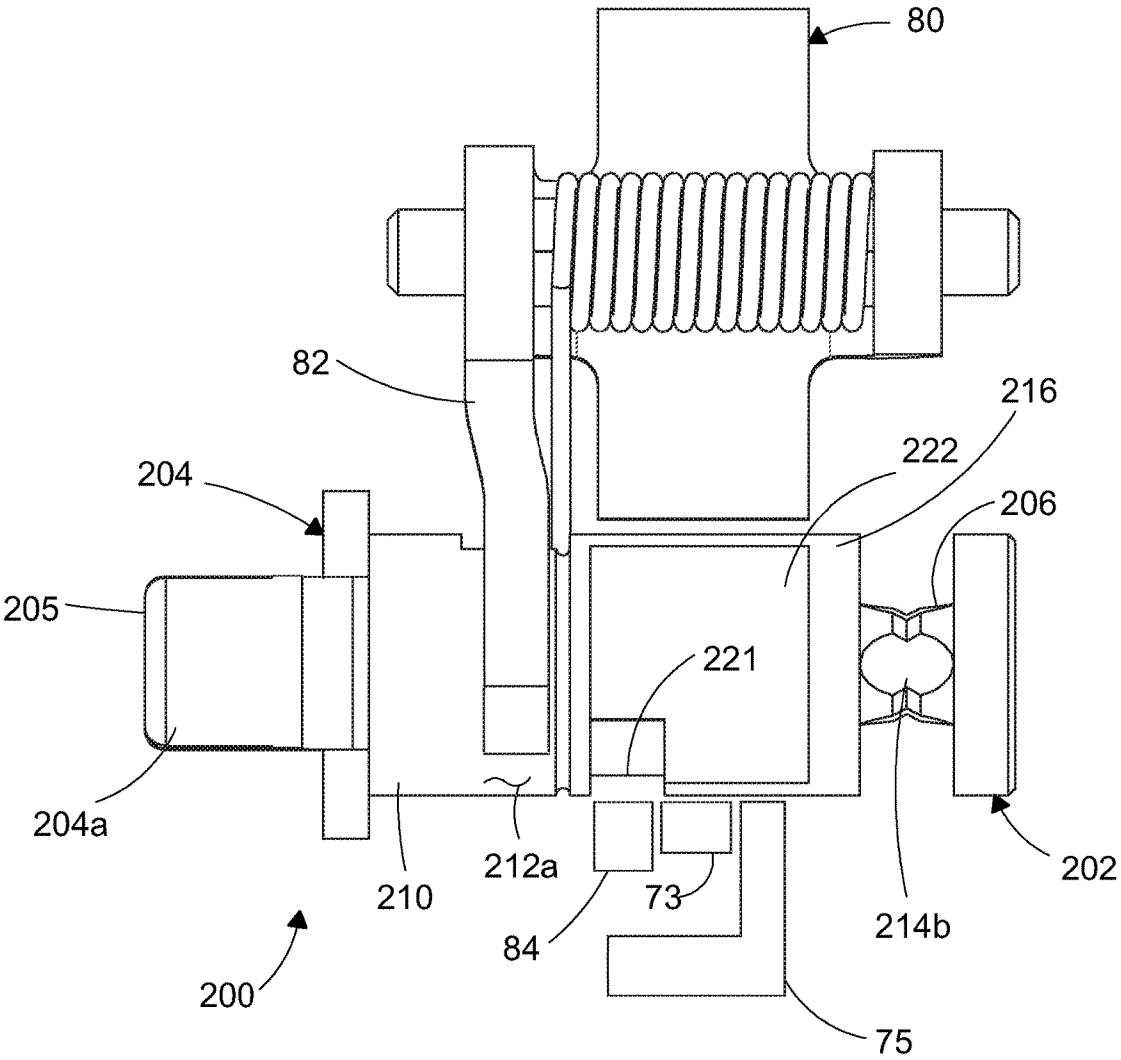
FIG. 7 is a rear elevation view of the trigger group and operating mode selection mechanism of FIG. 4 in the safety position.

Referring further to FIGS. 5-7, sear assembly 70 includes a disconnector or upper sear 72 and a lower sear 74 pivotal relative to upper sear 72 about pin arrangement 94. Upper sear 72 includes a hammer engagement member 76 that releasably retains hammer 90 in a cocked position during semi-automatic firing to provide time for the spent cartridge to be ejected and the next cartridge to be cycled into the firing chamber 44 of the upper receiver 36 (FIG. 3). Lower sear 74 includes a hammer engagement surface 78 to engage a sear engagement surface 79 of hammer 90 to hold hammer 90 in a cocked position until lower sear 74 is pivoted out of an engagement position by pulling trigger 92. As discussed further below, lower sear 74 can be pivoted to release hammer 90 in response to a manual pull of trigger 92 by a first amount that is sufficient to disconnect engagement surfaces 78, 79 in a mechanical firing mode, or pivoted in response to operation of an electronic actuator of electronic firing system 68 that is activated by a manual pull of trigger 92 a second amount that actuates the electronic actuator. In certain embodiments, the second amount is less than the first amount so that in an electronic firing mode the pull of the trigger 92 actuates the electronic actuator before disconnecting engagement surfaces 78, 79, but in the event of electronic failure a continuation of the trigger pull mechanically fires the selective fire firearm 30.

As shown in FIG. 6, trigger 92 includes a trigger arm 96 extending downwardly from a lower end of trigger 92 that is connected at its lower end to a trigger lever 98. Lower receiver 38 includes a removable trigger guard 54, as shown in FIG. 3, with a slot 95 for slidingly receiving trigger arm 96 and trigger lever 98. Trigger lever 98 extends into grip assembly 40 from trigger arm 96 toward a first switch 100, and trigger lever 98 is supported on a flexible actuator 102 for sliding movement therealong in response to pulling and releasing of trigger 92, which longitudinally displaces trigger arm 96 and trigger lever 98. Trigger lever 98 includes a U-shaped engagement end portion 108 that rides along flexible actuator 102, and flexible actuator 102 in engagement with a button 106 of first switch 100. Further details of trigger arm 96 and trigger lever 98 along with alternate arrangements for engaging and disengaging first switch 100 are shown in the above-mentioned '007 patent and also in U.S. patent application Ser. No. 14/818,638 to the present inventor filed on Aug. 5, 2015, which is incorporated herein by reference in its entirety for all purposes. Any arrangement is contemplated where pulling trigger 92 depresses button 106 to a depressed position and, when the electronic firing mode is enabled, actuates an electronic actuator 110 for electronic firing of selective fire firearm 30, as discussed further below.

Referring back to FIGS. 3-4, switch 100 is electrically connected to an electronic circuit 120 which controls electronic actuator 110 to fire selective fire firearm 30 in an electronic firing mode. Electronic circuit 120 includes a programmable printed circuit board 122 connected to electronic actuator 110 and a power source 124, such as batteries, connected to printed circuit board 122. First switch 100 is operable by trigger 92 to operate electronic actuator 110 when the electronic firing system 68 is turned on or operationally enabled by a second switch 130 that is movable between an on position and an off position. As discussed further below, second switch 130 is operable by selector mechanism 200 that allows the user or shooter to select the on/enable and off/disable positions for the electronic firing system 68. First switch 100 and second switch 130 are connected to printed circuit board 122 to allow the user or shooter to selectively control the electronic firing system 68 of selective fire firearm 30. Grip assembly 40 further includes a grip safety 140 that is pivotally mounted to a rearward side of grip assembly 40. Grip safety 140 includes a nub 142 that engages a third switch 126 of printed circuit board 122 to provide a further enablement feature for the electronic firing mode of selective fire firearm 30 with trigger 92 and electronic actuator 110 when grip safety 140 is depressed by the shooter and when second switch 130 is on.

Lower receiver 38 and grip assembly 40 are shown in section in FIGS. 3-4 with the interface between electronic firing system 68 and mechanical firing system 66. In the illustrated embodiment, electronic actuator 110 includes a solenoid 112 and an actuating member 114 that is linearly movable in response to activation of solenoid 112. Actuating member 114 includes an end member 116 and an elongated shaft 118 extending from end member 116 through a longitudinal bore of solenoid 112. The end of shaft 118 opposite end member 116 engages a flange 152 at a lower end of a sear displacement member 150. Sear displacement member 150 extends through fastening member 56 to a second end that engages, either directly or indirectly, a rearward end portion 75 of lower sear 74. As actuating member 114 moves upwardly in solenoid 112, it pushes on flange 152 to drive sear displacement member 150 longitudinally relative to fastening member 56 and into contact with end portion 75, which in turn pivots lower sear 74 to release trigger engagement surface 78 from sear engagement surface 79 of hammer 90, releasing hammer 90 from the cocked position to electronically fire the selective fire firearm 30. Further details of one embodiment of sear displacement member 150 and its arrangement and operation are provided in the aforementioned '638 application. However, other embodiments contemplate any suitable electronic actuator arrangement for firing selective fire firearm 30 in an electronic firing mode of operation.

As shown in FIG. 3, mode selector 204 is provided as part of selector mechanism 200 and is rotatably mounted to lower receiver 38. As mentioned above, mode selector 204 is movable between the safety mode position 204*a* shown further in FIGS. 4-7, the semi-automatic firing mode position 204*b* shown further in FIGS. 8-11, the automatic firing mode position 204*c* shown in FIGS. 12-15, and the electronic firing mode position 204*d* shown in FIGS. 16-19. In the safety mode position 204*a*, sear assembly 70 is blocked by a post portion 202 of selector mechanism 200 to prevent any mechanical firing mode of operation and second switch 130 is off to prevent an electronic firing mode of operation. In the semi-automatic firing mode position 204*b*, the upper sear 72 is allowed to pivot relative to post portion 202 to engage hammer 90 to allow the next cartridge to cycle and to allow the lower sear 74 to pivot relative to post portion 202 so hammer engagement surface 78 engages sear engagement surface 79 of hammer 90 to hold hammer 90 in a cocked position until lower sear 74 is pivoted out of this engagement position by pulling trigger 92. In the automatic firing mode position 204*c*, upper sear 72 is blocked from pivoting by post portion 202 to prevent it from engaging hammer 90, and the auto sear 80 is pivoted so it is positioned to temporarily engage hammer 90 after firing each round to allow the next round to chamber, after which the auto sear 80 releases the hammer 90 in response to the bolt carrier group reaching its forward most position. In the electronic firing mode position 204*d*, the sear assembly 70 is not blocked by post portion 202 to allow the actuator 110 to pivot the lower sear 74 to release the hammer 90 and to allow upper sear 72 to hold the hammer 90 until lower sear 74 re-engages the hammer 90 at engagement surfaces 78, 79.

The position portion 202 of selector mechanism 200 extends from mode selector 204 and into the upper receiver 38 along sear assembly 70 and also along an arm 82 of auto sear 80. Selector mechanism 200 is also engaged to a detent mechanism 180. Detent mechanism 180 is engaged to an outer cam region 206 of post portion 202 that is opposite mode selector 204. Cam region 206 is linked to a second flexible actuator 132 associated with second switch 130 via detent mechanism 180. Second flexible actuator 132 is in contact with a second button 134 of second switch 130. Outer cam region 206 includes four cam locations 214*a*, 214*b*, 214*c* and 214*d* with cam surfaces therebetween, as shown in FIGS. 4, 7, 8, 11, 12, 15, 16 and 19. Detent mechanism 180 is normally biased into engagement with outer cam regions 206 and rides along the cam surfaces between the cam locations 214*a*, 214*b*, 214*c* and 214*d* as mode selector 204 is moved between the various selector positions at cam locations 214*a*, 214*b*, 214*c* and 214*d*. Detent mechanism 180 positively engages a respective one of the cam locations 214*a*, 214*b*, 214*c* and 214*d* when aligned therewith to provide a positive stop and an audible indication that a corresponding safety selector operating mode position 204*a*, 204*b*, 204*c*, 204*d* has been reached.

Referring to FIGS. 3-4, detent mechanism 180 includes a first rod member 182 and a second rod member 184 abuttingly engaged to one another in an end-to-end manner. First rod member 182 includes a first end that is engaged to outer cam region 206, as discussed above, and an opposite second end abuttingly engaged to a first end of second rod member 184. Second rod member 184 extends between its first end and an opposite second end that contacts second flexible actuator 132 of second switch 130. Second rod member 184 includes a flange 186 adjacent its first end, and a spring 188 extends around second rod member 184 and abuttingly engages flange 186 at a first end of spring 188 and abuttingly engages any suitable support surface in grip assembly 40. Further details of one embodiment of detent mechanism 180 and its arrangement and operation are provided in the aforementioned '638 application. However, other embodiments contemplate any suitable detent mechanism for actuating second switch 130 with selector mechanism 200.

Figure 8:
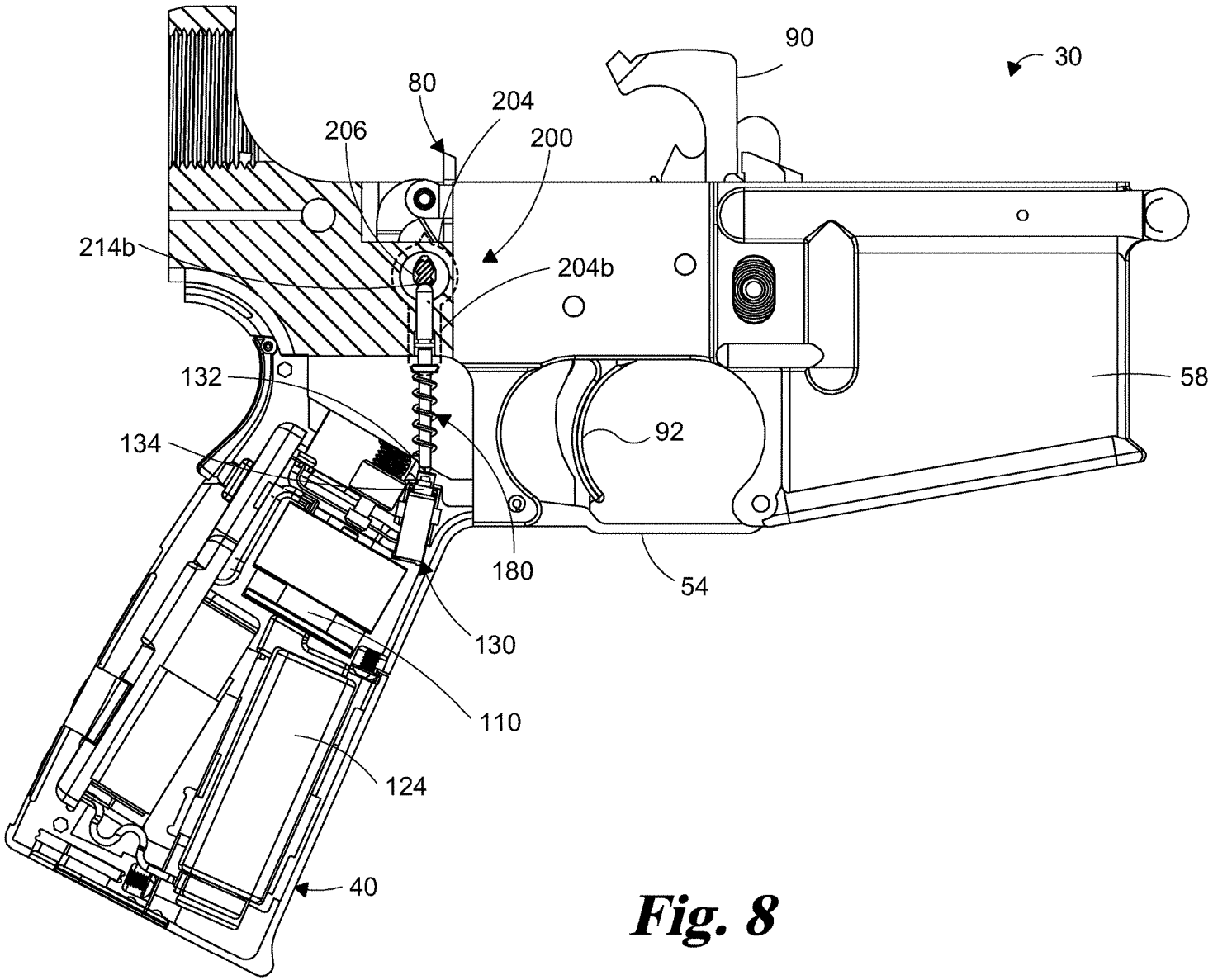
FIG. 8 is a side elevation cutaway view of the lower receiver/grip assembly of FIG. 3 with the operating mode selection mechanism in a semi-automatic firing mode position.
Figure 9:
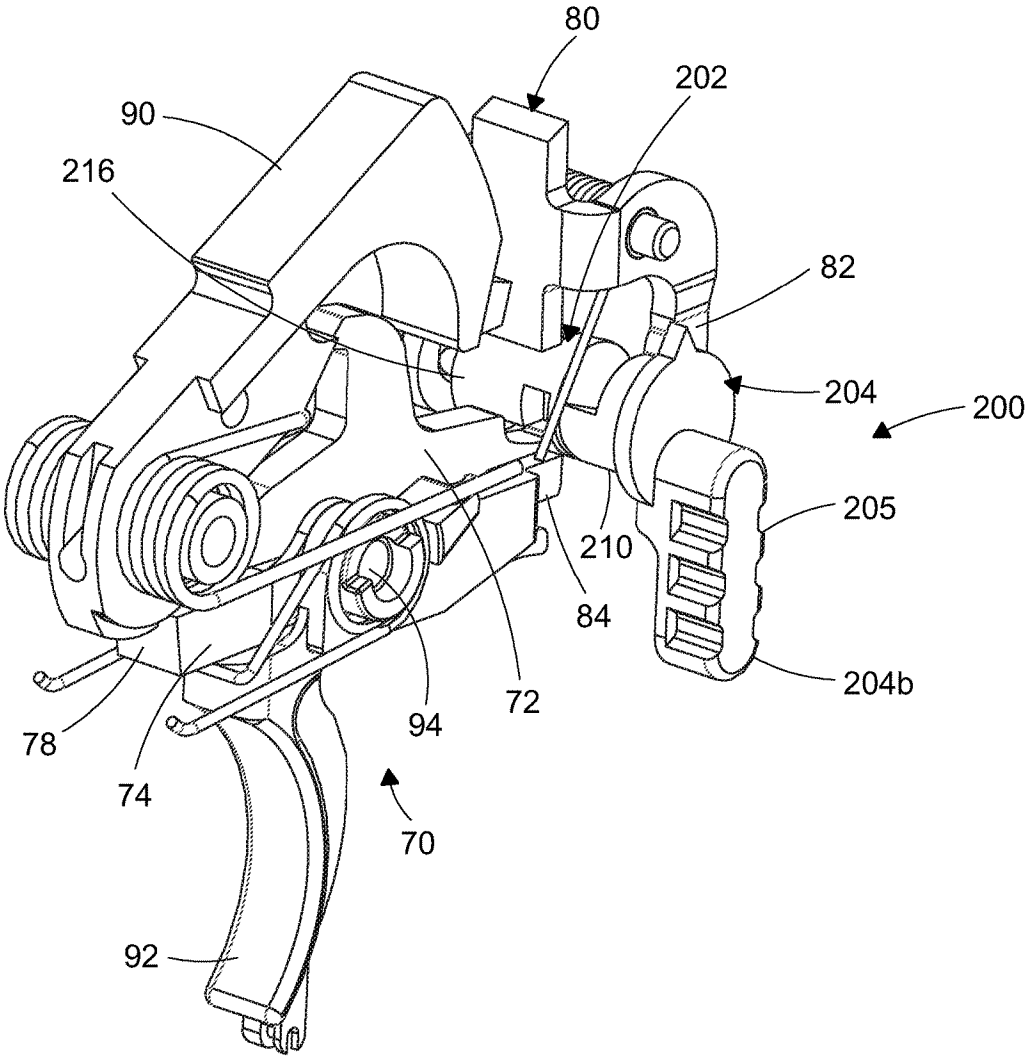
FIG. 9 is a perspective view of a trigger group from the lower receiver/grip assembly of FIG. 8 showing the operating mode selection mechanism in the semi-automatic firing mode position.
Figure 10:
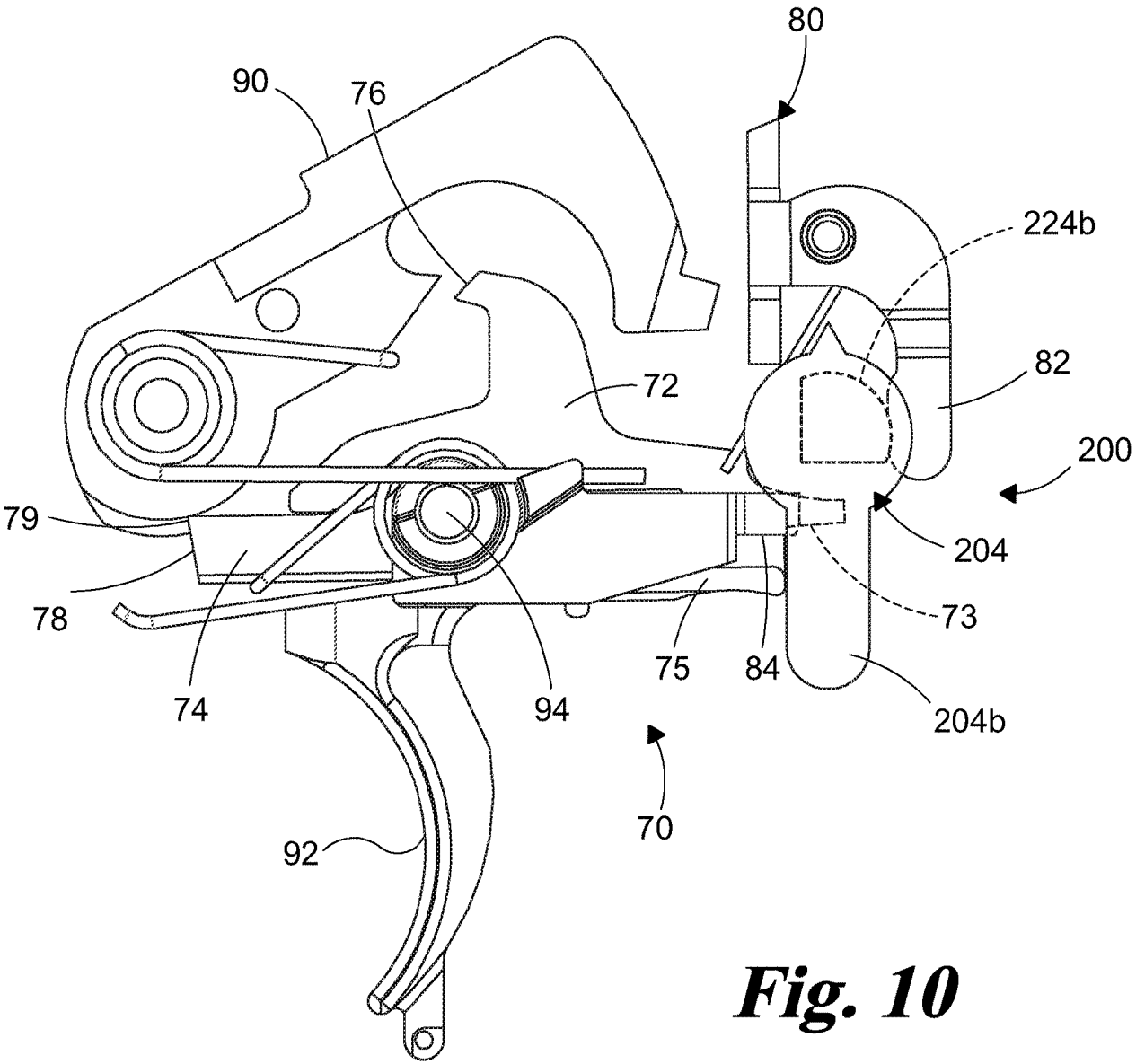
FIG. 10 is a side elevation of the trigger group and operating mode selection mechanism of FIG. 8 in the semi-automatic firing mode position.
Figure 11:
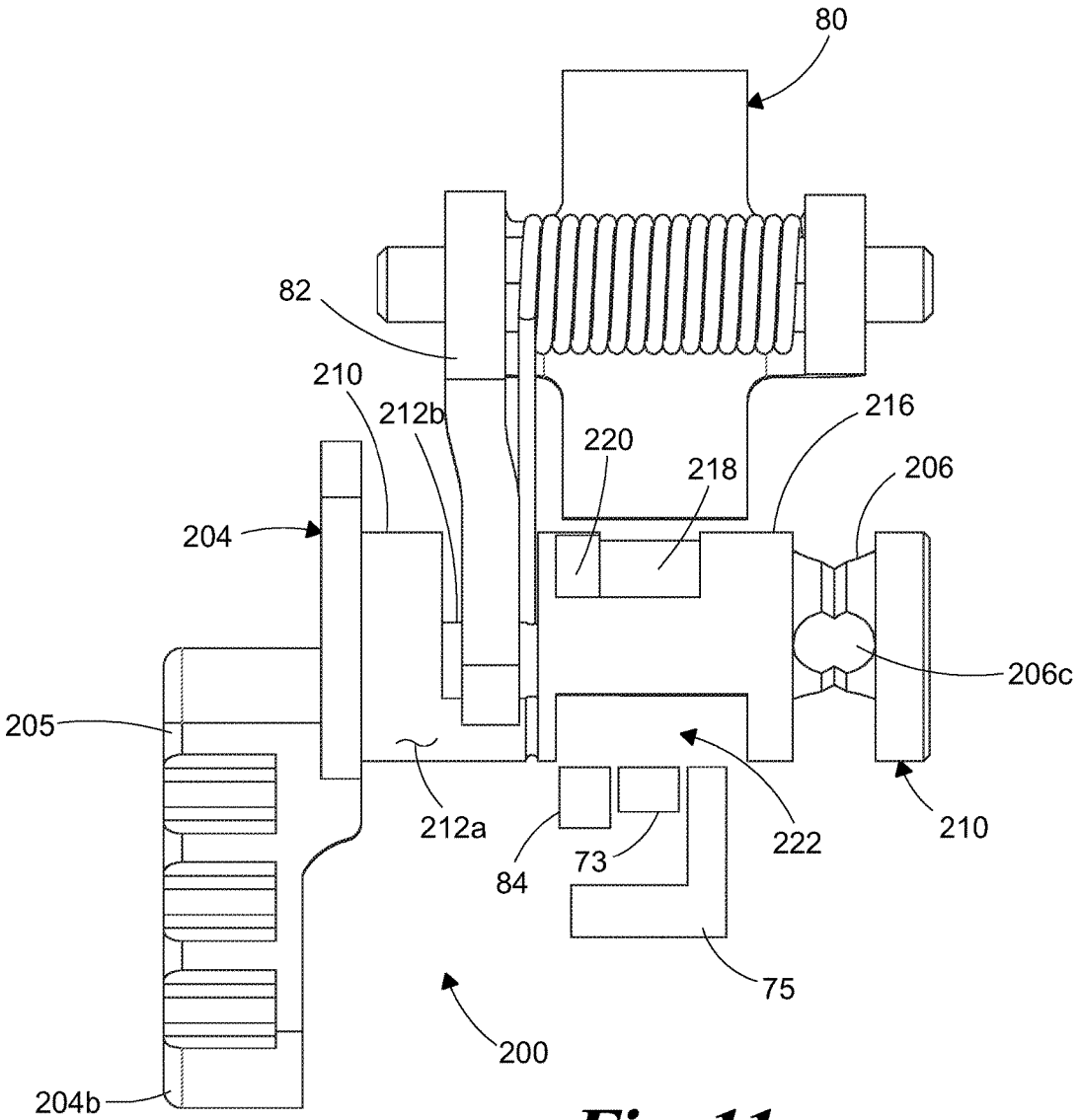
FIG. 11 is a rear elevation view of the trigger group and operating mode selection mechanism of FIG. 8 in the semi-automatic firing mode position.
Figure 12:
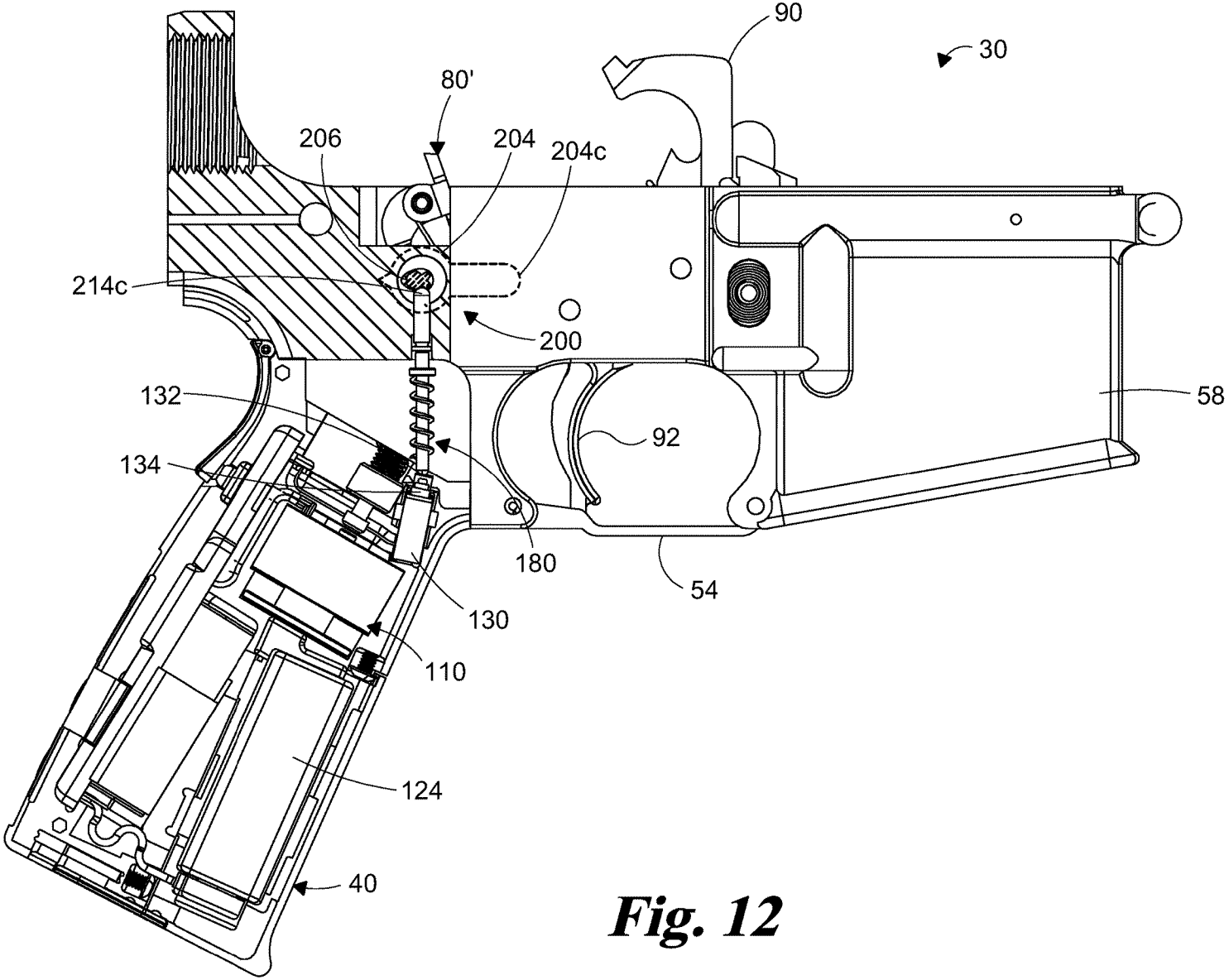
FIG. 12 is a side elevation cutaway view of the lower receiver/grip assembly of FIG. 3 with the operating mode selection mechanism in an automatic firing mode position.
Figure 13:
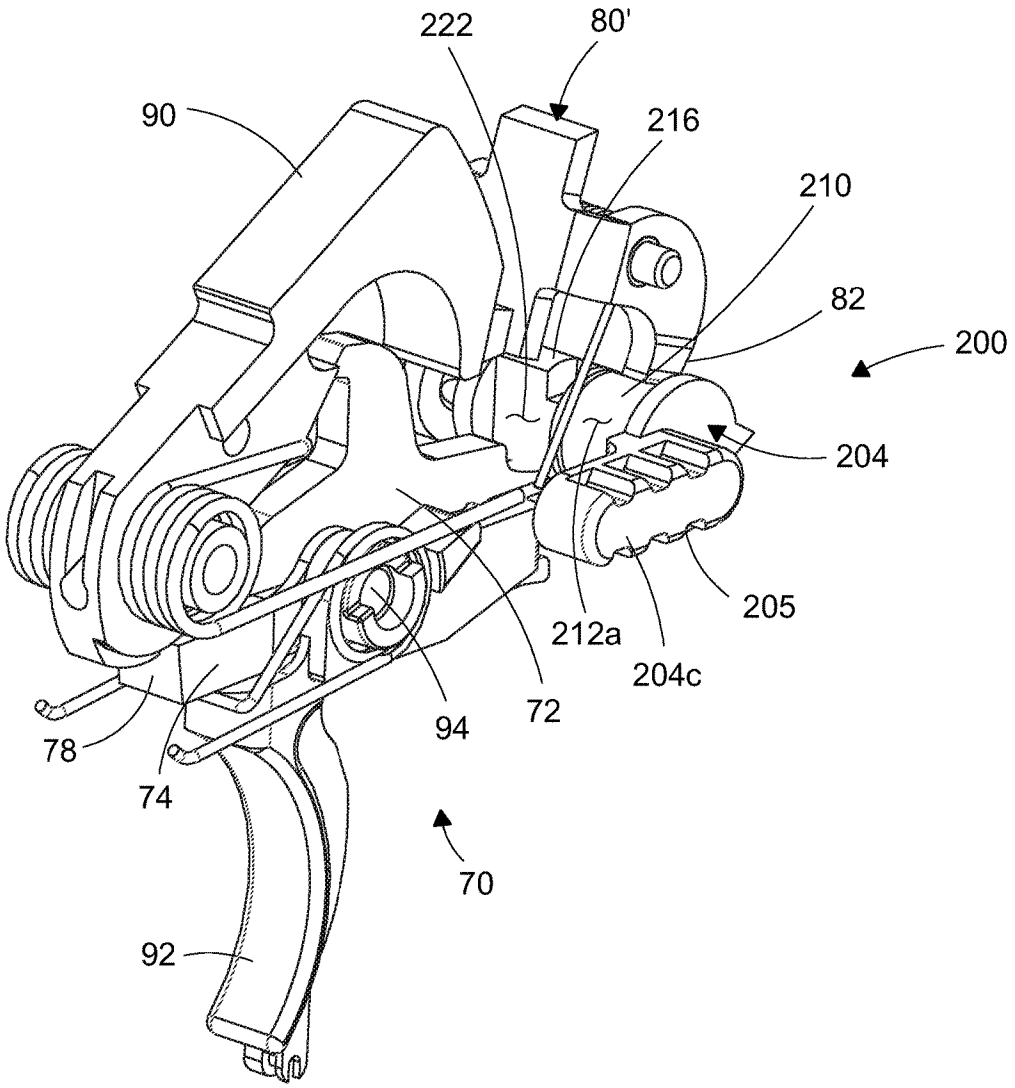
FIG. 13 is a perspective view of a trigger group from the lower receiver/grip assembly of FIG. 12 showing the operating mode selection mechanism in the automatic firing mode position.
Figure 14:
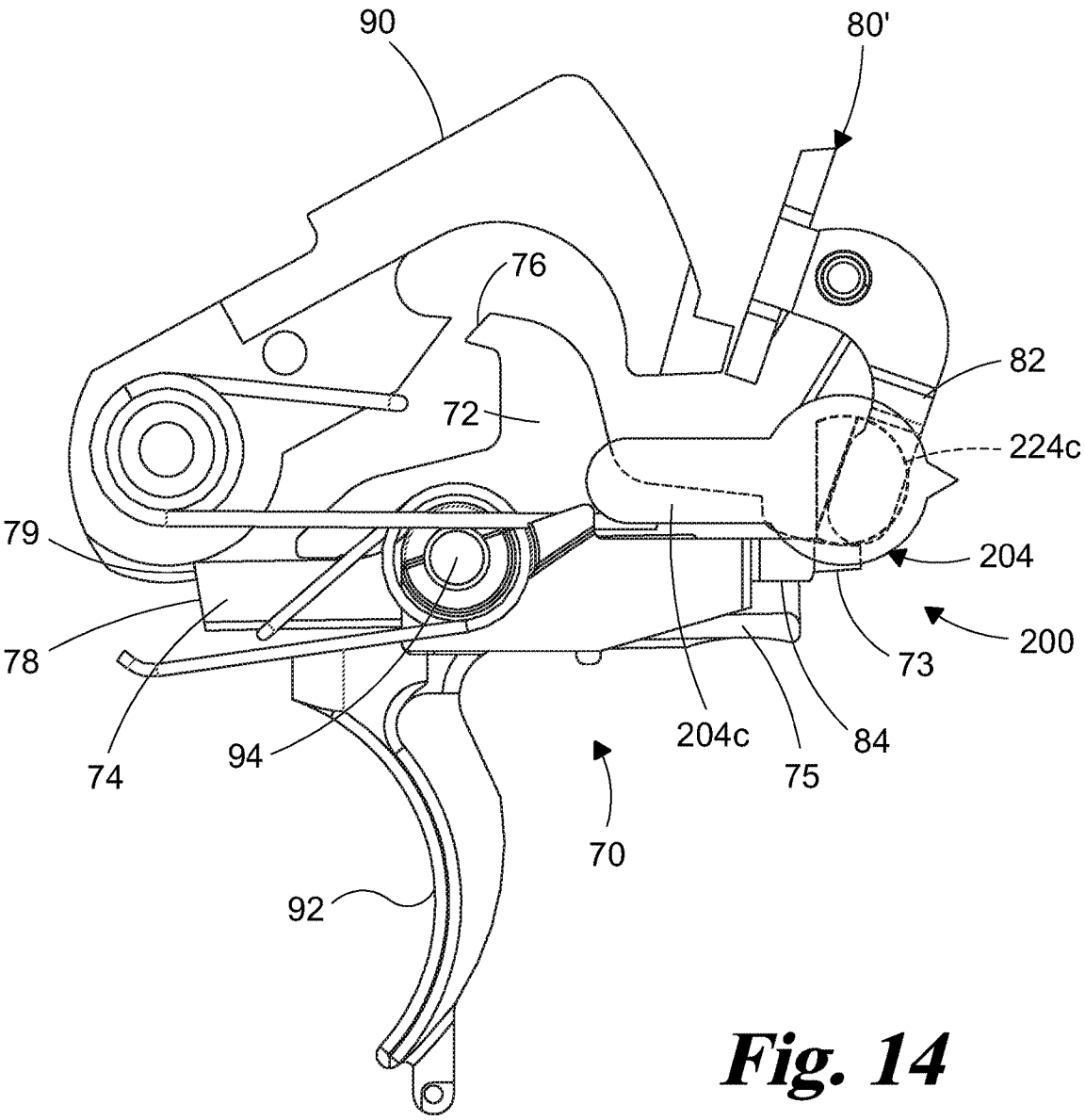
FIG. 14 is a side elevation of the trigger group and operating mode selection mechanism of FIG. 12 in the automatic firing mode position.
Figure 15:
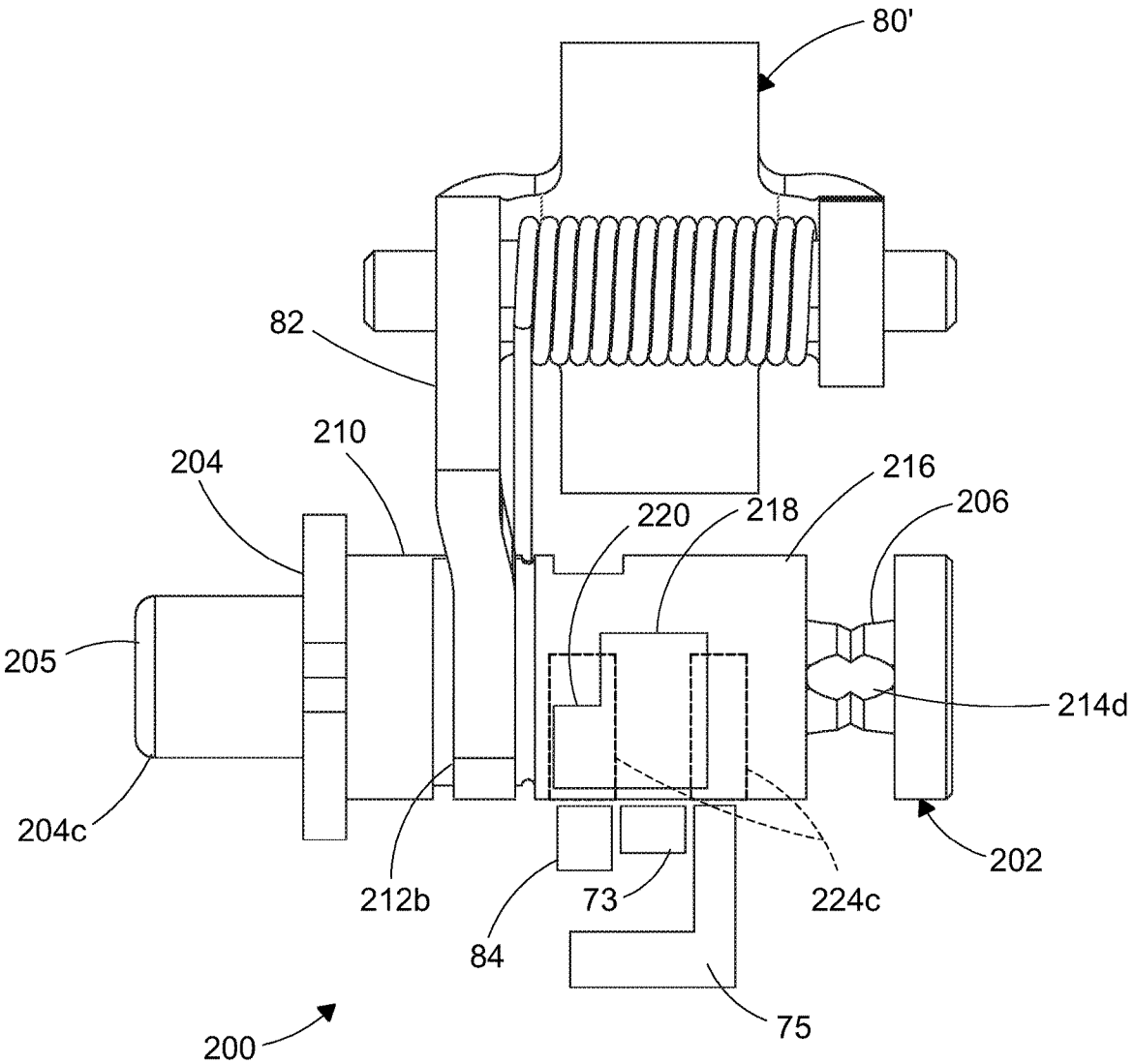
FIG. 15 is a rear elevation view of the trigger group and operating mode selection mechanism of FIG. 12 in the automatic firing mode position.
Figure 16:
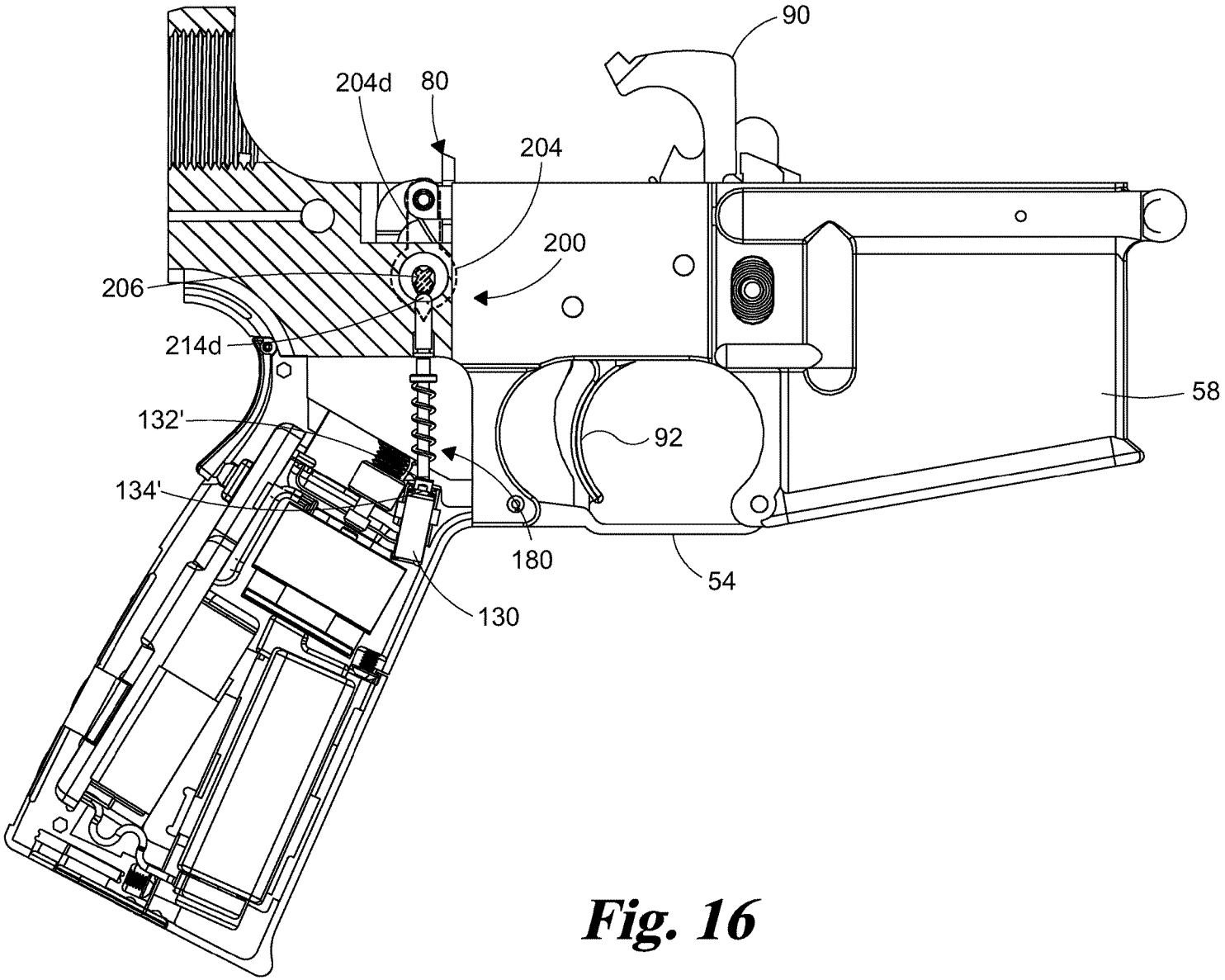
FIG. 16 is a side elevation cutaway view of the lower receiver/grip assembly of FIG. 3 with the operating mode selection mechanism in an electronic firing mode position.
Figure 17:
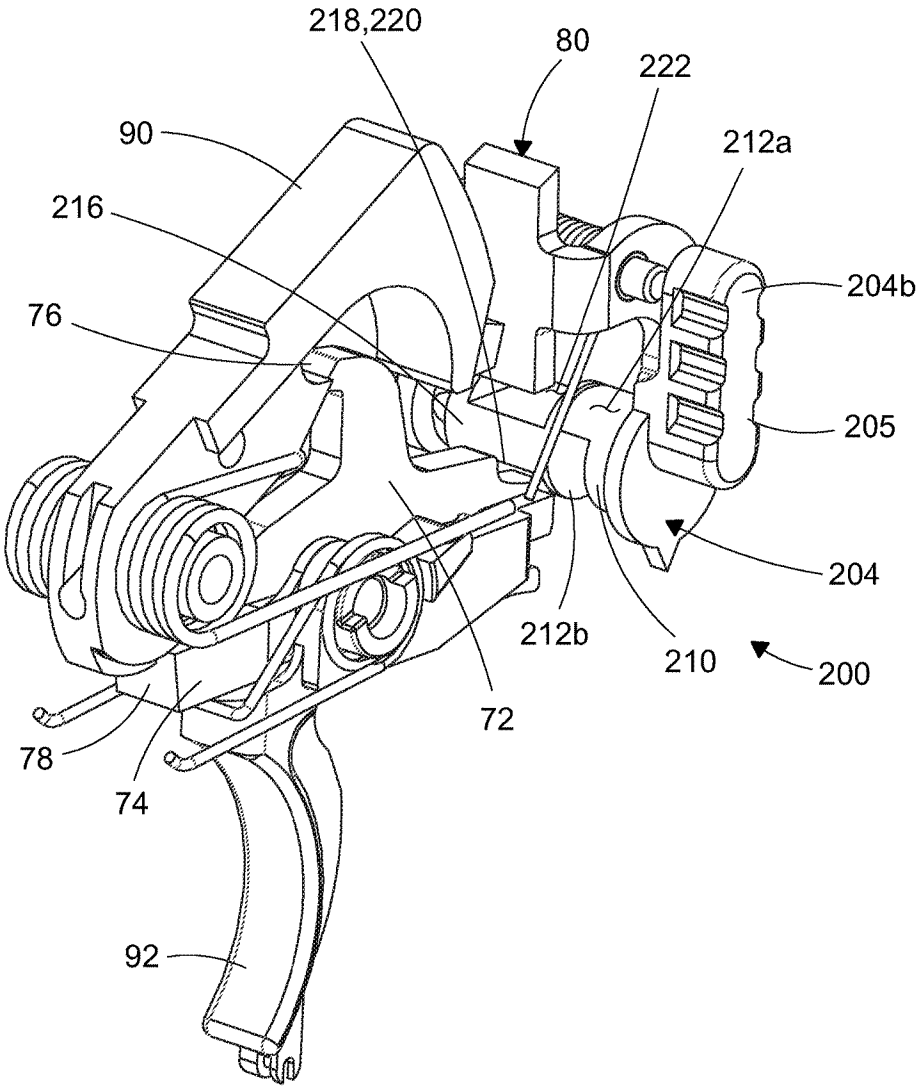
FIG. 17 is a perspective view of a trigger group from the lower receiver/grip assembly of FIG. 16 showing the operating mode selection mechanism in the electronic firing mode position.
Figure 18:
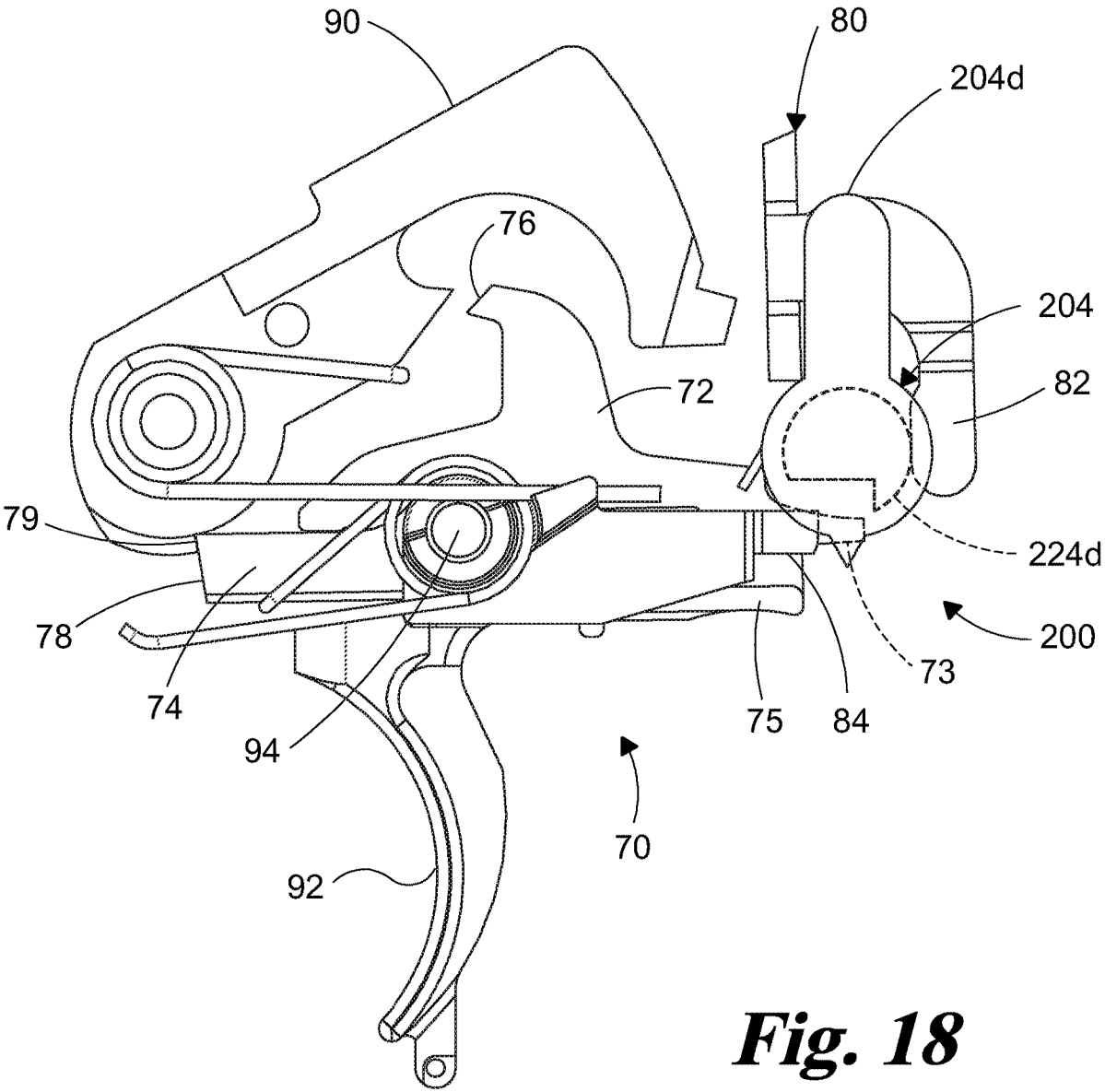
FIG. 18 is a side elevation of the trigger group and operating mode selection mechanism of FIG. 16 in the electronic firing mode position.
Figure 19:
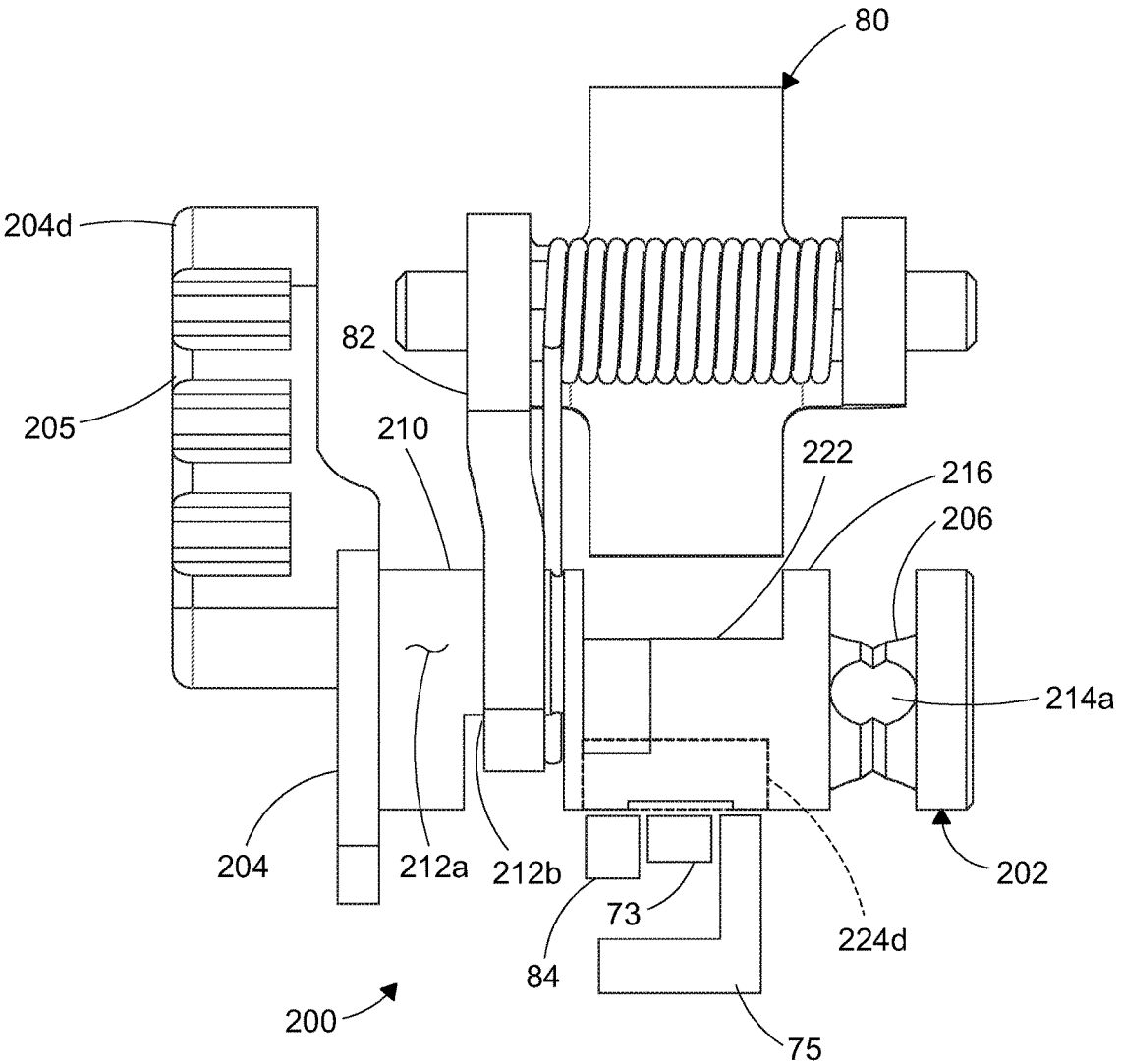
FIG. 19 is a rear elevation view of the trigger group and operating mode selection mechanism of FIG. 16 in the electronic firing mode position.

When mode selector 204 is in any of the safety mode position 204*a*, the semi-automatic firing mode position 204*b*, and the automatic firing mode position 204*c* as shown in FIGS. 4, 8 and 12, respectively, the cam region 206 is configured so second button 134 is not depressed (i.e. in an off position) so that the electronic firing system 68 is not activated by pulling trigger 92 to depress button 106 of first switch 100, preventing an electronic mode of firing. As shown in FIG. 16, when mode selector 204 is moved to the electronic firing mode position 204*d*, cam region 206 is configured to displace detent mechanism 180 to push on second flexible actuator 132. For example, cam location 214*d* can be configured so that when it faces downwardly it is spaced a lesser distance from flexible actuator 132 than the other cam locations 214*a*, 214*b*, 214*c*. The pivoted flexible actuator 132' in turn depresses second button 134 of second switch 130 to a depressed position 134', which in turn activates the electronic firing system 68 associated with electronic actuator 110 and enables an electronic mode of firing by pulling trigger 92 to depress button 106 of first switch 100.

Referring generally to FIGS. 4-19, selector mechanism 200 includes a thumb lever 205 projecting from mode selector 204 that is accessible by the shooter to rotate mode selector 204 to the desired position. Selector mechanism 200 further includes post portion 202 extending from mode selector 204 in a direction opposite thumb lever 205 so that post portion 202 resides in a bore in lower receiver 38 to rotatably secure selector mechanism 200 to lower receiver 38. An auto sear engaging portion 210 is defined by post portion 202 adjacent to mode selector thumb lever 205. Auto sear engaging portion 210 defines first and second outer surface regions 212*a*, 212*b* that are in engagement with a downwardly extending arm 82 of auto sear 80. The first outer surface region 212*a* is cylindrical in shape and is configured so that auto sear 80 is held away from hammer 90 so it does not engage hammer 90 during firing when selector mechanism 200 is in any of the safety mode position 204*a*, the semi-automatic firing mode position 204*b*, and the electronic firing mode position 204*d*. Second outer surface region 212*b* interrupts the cylindrical shape of first outer surface region 212*a* and defines a chord extending across the cylindrically shaped portion of auto sear engaging portion 210 that is configured to allow the lower end of auto sear 80 to pivot toward hammer 90 and engage hammer 90 during the automatic firing mode, as shown by the pivoted auto sear 80' in FIGS. 12-15.

Post portion 202 further includes a sear assembly blocking portion 216 between auto sear engaging portion 210 and cam region 206. Sear assembly blocking portion 216 includes a first notch 216 and a second notch 218 in side-by-side relation on a first side of post portion 202. Sear assembly blocking portion 216 also includes a recessed sidewall 222 opposite notches 216, 218. In the safety mode position of FIGS. 4-7, sear assembly blocking portion 216 is oriented so that trigger tail 84 of trigger 92, tail 73 of upper sear 72, and, in certain embodiments, rear end portion 75 of lower sear 74 are blocked to prevent actuation of sear assembly 70 to release and/or cock hammer 90. By blocking pivoting movement of sear assembly 70, sear assembly 70 cannot be disengaged from hammer 90 by pulling trigger 92 or dropping or jarring selective fire firearm 30, even if hammer 90 is in the cocked position. Furthermore, in one embodiment, sear assembly 70 cannot pivot to allow movement of hammer 90 from the uncocked position to the cocked position when mode selector 204 is in the safety mode position 204*a*. However, in another embodiment hammer 90 can be cocked and uncocked when mode selector 204 is in the safety mode position 204*a*. As shown diagrammatically in FIG. 6, a blocking surface diagram 224*a* for post 202 in the safety mode position 204*a* shows contact of first outer surface region 212*a* of auto sear positioning portion 210 with auto sear 80 to prevent it from pivoting toward and engaging hammer 90. In addition, sear assembly blocking portion 216 contacts or is positioned to block one or more of trigger tail 84, upper sear tail 73, and lower sear rear end portion 75 to prevent pivoting thereof. Furthermore, notch 221 allows trigger 92 to pivot in either of the semi-automatic and automatic firing modes, but in the orientation of FIG. 7 is sufficiently shallow to prevent trigger 92 from releasing hammer 90.

Referring now to FIGS. 8-11, in the semi-automatic firing mode position 204*b*, the mode selector 204 is oriented so that sear assembly blocking portion 216 does not block trigger tail 84 of trigger 92, tail 73 of upper sear 72, and rear end portion 75 of lower sear 74. Thus, trigger 92 can be pulled to release hammer 90, and upper sear 72 can pivot to engage hammer 90 with hammer engagement member 76 after the round is fired until engagement surfaces 78, 79 of hammer 90 and lower sear 74 engage one another. As shown diagrammatically in FIG. 10, a blocking surface diagram 224*b* for post 202 in the semi-automatic firing mode position 204*b* shows contact of arm 82 of auto sear 80 with first outer surface region 212*a* of auto sear positioning portion 210 to prevent auto sear 80 from pivoting toward and engaging hammer 90. Furthermore, there is no contact between sear assembly blocking portion 216 with trigger tail 84, upper sear tail 73, and lower sear rear end portion 75 to allow operation of sear assembly 70.

Referring now to FIGS. 12-15, in the automatic firing mode position 204*c*, the mode selector 204 is oriented so that sear assembly blocking portion 216 does not block trigger tail 84 of trigger 92 or rear end portion 75 of lower sear 74, but tail 73 of upper sear 72 is blocked to prevent upper sear 72 from engaging hammer 90. For example, trigger tail 84 and rear end portion 75 can pivot and move along the forward facing recessed sidewall 222, while tail 73 extends further rearwardly and is blocked by sear assembly blocking portion 216. Furthermore, auto sear engaging portion 210 is oriented so arm 82 of auto sear 80 engages second outer surface region 212*b* of auto sear engaging portion 210, allowing auto sear 80 to pivot to its pivoted position 80' so it can temporarily engage hammer 90 during automatic firing. Thus, trigger 92 can be pulled to release hammer 90, and pivoted auto sear 80' temporarily engages hammer 90 to allow chambering of the next round while the trigger 92 remains pulled. As shown diagrammatically in FIGS. 14 and 15, a blocking surface diagram 224*c* for post 202 in the automatic firing mode position 204*c* shows contact of auto sear positioning portion 210 with auto sear 80' in its pivoted position. In addition, sear assembly blocking portion does not contact trigger tail 84 or lower sear rear end portion 75, while tail 73 of upper sear 72 is blocked to prevent upper sear 72 from engaging hammer 90.

Referring now to FIGS. 16-19, in the electronic firing mode position 204*d*, the mode selector 204 is oriented so that sear assembly blocking portion 216 does not block trigger tail 84 of trigger 92, tail 73 of upper sear 72, and rear end portion 75 of lower sear 74. Furthermore, detent mechanism 180 engages the actuator 132 of second switch 130 to pivot actuator 132 to pivoted position 132' and depress button 134 to depressed position 134'. Thus, trigger 92 can be pulled to engage first switch 100 in order to actuate actuator 110 to push against rear end portion 75 and release hammer 90 from a cocked position. In addition, upper sear 72 can pivot to engage hammer 90 with hammer engagement member 76 after the round is fired until engagement surfaces 78, 79 of hammer 90 and lower sear 74 engage one another. As shown diagrammatically in FIGS. 18 and 19, a blocking surface diagram 224*d* for post 202 in the electronic firing mode position 204*d* shows contact of arm 82 of auto sear 80 with first outer surface region 212*a* of auto sear positioning portion 210 to prevent auto sear 80 from pivoting toward and engaging hammer 90. In addition, notches 218, 220 in auto sear engaging portion 216 of post portion 202 are oriented to receive trigger 92, tail 73 of upper sear 72, and rear end portion 75 of lower sear 74. Therefore, post portion 202 does not contact trigger tail 84, upper sear tail 73, and lower sear rear end portion 75 to allow operation of selective fire firearm 30 in the electronic firing mode.

Electronic firing system 68 can be utilized in conjunction with existing semi-automatic and automatic weaponry designs to improve firearm operations and facilitate selection of the firing mode or safety of the firearm. For example, the grip assembly of an existing selective fire firearm can be removed and replaced with grip assembly 40 including the electronic firing system, and the existing trigger and trigger guard can be replaced with the trigger 92, trigger lever 98, and trigger guard 54. In addition, the existing selector mechanism can be replaced with selector mechanism 200 with the further addition of detent mechanism 180 to selectively enable and disable the electronic firing mode capabilities.

For example, referring to FIG. 1, grip assembly 40 can include user inputs 230*a*, 230*b* and indicators 232 that are connected to printed circuit board 122 with electronic circuit 120. Inputs 230*a*, 230*b* can include, for example, buttons, keypads, voice input devices, or other suitable devices by which the user can input information, and/or to select the behavior or shooting mode for selective fire firearm 30 when in the electronic firing mode. Indicators 232 can include LED's, lights, audible devices, a display, or other suitable indicator to output various information to the shooter.

Various aspects of the present disclosure are contemplated. For example, according to one aspect, a selective fire firearm includes a lower receiver and a trigger pivotal relative to the lower receiver. The lower receiver includes a hammer movable from a cocked position to an uncocked position to fire the firearm, and the lower receiver further includes a sear assembly and an auto sear that are each positionable to releasably engage the hammer. The selective fire firearm also includes a grip assembly attached to the lower receiver and an electronic firing system in at least one of the grip assembly and the lower receiver. The electronic firing system includes an electronic actuator with a sear displacement member that is movable in response to a pull of the trigger when the electronic firing system is enabled. The selective fire firearm also includes a selector mechanism with a mode selector movable between a safety mode position where the sear assembly is blocked from movement by the selector mechanism, a semi-automatic firing mode position wherein an upper sear and a lower sear of the sear assembly are movable relative to the selector mechanism to engage the hammer in the cocked position, an automatic firing mode position where the selector mechanism blocks movement of the upper sear and the auto sear is positioned by the selector mechanism to temporarily engage the hammer in the cocked position, and an electronic firing mode position in which the electronic firing system is enabled so the pull of the trigger actuates the electronic actuator to move the lower sear to release the hammer from the cocked position and the upper sear and lower sear are movable relative to the selector mechanism to engage the hammer in the cocked position.

In one embodiment, the electronic firing system includes a first switch that actuates the electronic actuator in response to the trigger being pulled with the selector mechanism in the electronic firing mode position. In a refinement of this embodiment, a second switch is in the grip assembly and a detent mechanism is engaged to the selector mechanism and the second switch. The electronic firing mode position of the selector mechanism displaces the detent mechanism to activate the second switch which enables operation of the electronic firing system. In yet a further refinement, the selector mechanism is configured so that the second switch is not activated by the detent mechanism when the selector mechanism is in the safety mode position, the semi-automatic firing mode position, and the automatic firing mode position. In still a further refinement, the selector mechanism includes a post portion extending from the mode selector and a cam region at an end of the post portion that is opposite the mode selector. The cam region defines a first cam location corresponding to the safety mode position, a second cam location corresponding to the semi-automatic firing mode position, a third cam location corresponding to the automatic firing mode position, and a fourth cam location corresponding to the electronic firing mode position. Each of the first, second, third and fourth cam locations is formed by a recess in the post portion.

In another embodiment, the selector mechanism includes a post portion extending from the mode selector, and the post portion includes an auto sear positioning portion adjacent the mode selector and a sear assembly blocking portion extending from the auto sear positioning portion. In a refinement of this embodiment, the post portion includes a cam region at an end of the post portion that is opposite the mode selector, and the cam region is engaged with a detent mechanism that is connected with the electronic firing system. In a further refinement, the cam region defines a first cam location corresponding to the safety mode position, a second cam location corresponding to the semi-automatic firing mode position, a third cam location corresponding to the automatic firing mode position, and a fourth cam location corresponding to the electronic firing mode position. Each of the first, second, third and fourth cam locations is formed by a recess in the post portion.

In another refinement of previous embodiment, the auto sear includes an arm extending along the auto sear positioning portion in contact therewith. The auto sear positioning portion includes a cylindrical first outer surface region and a second outer surface region that interrupts the cylindrical first outer surface region. The arm of the auto sear is in contact with the first outer surface region in the safety mode position, the semi-automatic firing mode position, and the electronic firing mode position. The arm of the auto sear is in contact with the second outer surface region in the automatic firing mode position, which is configured to allow the auto sear to pivot toward the hammer for temporary engagement of the hammer with the auto sear in the automatic firing mode.

In another refinement of previous embodiment, the sear assembly blocking portion includes a cylindrically shape body portion with a recessed surface on a first side of the cylindrically shaped body portion and a first notch and a second notch on an opposite side of the cylindrically shaped body portion. In a further refinement, the upper sear of the sear assembly includes a rearwardly extending tail and the lower sear includes a rearward end portion. In the safety mode position, the cylindrically shaped body portion of the sear assembly blocking portion blocks the tail of the upper sear and the rearward end portion of the lower sear to prevent the upper sear and lower sear from pivoting. In the semi-automatic firing mode position, the recessed surface faces the tail of the upper sear and the rearward end portion of the lower sear and is spaced therefrom to allow pivoting movement of the upper sear and the lower sear. In the automatic firing mode position, the recessed surface faces forwardly and the rearward end portion of the lower sear is pivotal along the recessed surface and the tail of the upper sear extends rearwardly along the cylindrically shaped body portion and is blocked thereby. In the electronic firing mode position, the first and second notches face toward the tail of the upper sear and the rearward end portion of the lower sear and the first and second notches receive the tail of the upper sear and the rear end portion of the lower sear in response to pivoting of the upper sear and the lower sear.

According to another aspect, a selective fire firearm includes a lower receiver and a trigger pivotal relative to the lower receiver about a pin arrangement. The lower receiver includes a hammer movable from a cocked position toward an uncocked position to fire the firearm. The lower receiver further includes a sear assembly operable to secure the hammer in the cocked position and an auto sear operable to temporarily engage the hammer. The selective fire firearm also includes a grip assembly extending from the lower receiver and an electronic firing system with an electronic actuator and a switch that actuates the electronic actuator when the electronic firing system is enabled to disengage the hammer from the sear assembly in response to a pull of the trigger. The selective fire firearm also includes a selector mechanism rotatably mounted to the lower receiver. The selector mechanism includes an operating mode selector positioned on an outside of the lower receiver and a post portion extending into the lower receiver. The post portion includes an auto sear positioning portion engaged to the auto sear, a sear assembly blocking portion engageable with the sear assembly, and an outer cam region engageable with the electronic firing system to selectively enable and disable the electronic firing system.

In one embodiment, the selector mechanism is movable between: a safety mode position in which the sear assembly is blocked by the sear assembly blocking portion from pivoting to prevent firing of the selective fire firearm; a semi-automatic firing mode position in which the sear assembly blocking portion is oriented relative to the sear assembly so the sear assembly is movable to fire the selective fire firearm and the auto sear positioning portion positions the auto sear to prevent it from engaging the hammer; an automatic firing mode position in which the auto sear is positioned by the auto sear positioning portion to temporarily engage the hammer while an upper sear of the sear assembly is blocked by the sear assembly blocking portion and prevented from pivoting to engage the hammer; and an electronic firing mode position in which the sear assembly blocking portion is oriented so the sear assembly is pivotable by the electronic actuator to fire the selective fire firearm.

In another embodiment, the sear assembly blocking portion includes a cylindrically shaped body portion with a recessed surface on a first side of the cylindrically shaped body portion and a first notch and a second notch on an opposite side of the cylindrically shaped body portion. In yet another embodiment, the auto sear includes an arm extending along the auto sear positioning portion in contact therewith. The auto sear positioning portion includes a cylindrical first outer surface region and a second outer surface region that interrupts the cylindrical first outer surface region. The arm of the auto sear is in contact with the first outer surface region in each of a safety mode position, in a semi-automatic firing mode position, and in an electronic firing mode position of the selector mechanism. The arm of the auto sear is in contact with the second outer surface region in an automatic firing mode position of the selector mechanism. In still another embodiment, the outer cam region defines a plurality of cam locations corresponding to respective ones of a plurality of operating mode positions of the selector mechanism, and each of the plurality of cam locations is formed by a recess in the post portion.

According to another aspect, a method for retrofitting a selective fire firearm is disclosed. The selective fire firearm includes an upper receiver and a lower receiver engaged to the upper receiver, a grip engaged to the lower receiver and a hammer, a trigger, and a sear assembly engaged between the hammer and the trigger, and an auto sear for temporarily engaging the hammer in an automatic firing mode. The method includes replacing the grip of the selective fire firearm with a grip assembly that includes an electronic firing system including an electronic actuator and a switch that actuates the electronic actuator to disengage the hammer from the sear assembly in response to a pull of the trigger in an electronic firing mode; inserting a detent mechanism into the upper receiver in engagement with the electronic firing system; engaging a selector mechanism to the upper receiver, the selector mechanism including a cam region; and engaging the cam region to the detent mechanism. The selector mechanism is movable between a safety mode position in which the selector mechanism blocks the sear assembly, a semi-automatic firing mode position in which the sear assembly is operable to fire the selective fire firearm in a semi-automatic mode, an automatic firing mode position in which a portion of the sear assembly is blocked by the selector mechanism and the auto sear is pivoted for temporary engagement of the hammer in the automatic firing mode, and an electronic firing mode position in which the cam region displaces the detent mechanism to enable the electronic firing system and the sear assembly is operable to fire the selective fire firearm in the electronic firing mode.

In one embodiment, the cam region is configured so the electronic firing system is not enabled when the selector mechanism is in any of the safety mode position, the semi-automatic firing mode position, and the automatic firing mode position. In another embodiment, the method includes replacing the trigger with a modified trigger including a trigger arm engaged to a trigger lever that engages the switch to actuate the electronic actuator when the electronic firing system is enabled by the detent mechanism via the selector mechanism being in the electronic firing mode position. In yet another embodiment, the selector mechanism includes an operating mode selector positioned on an outside of the lower receiver and a post portion extending into the lower receiver to the cam region, the post portion including an auto sear positioning portion adjacent to the operating mode selector that is engaged to the auto sear, and the post portion further includes a sear assembly blocking portion adjacent to the cam region that is engageable with the sear assembly.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus for a selective fire firearm, comprising:

a selectively enabled electronic firing system including an electronic actuator that is operable to fire the firearm in response to a pull of a trigger of the firearm and the electronic firing system being enabled by activation of a switch;

a selector mechanism including a mode selector movable between a safety mode position to prevent firing of the firearm, a semi-automatic firing mode position to enable a semi-automatic firing of the firearm, an automatic firing mode position to enable automatic firing of the firearm, and an electronic firing mode position; and a detent mechanism engaged to the selector mechanism, wherein the selector mechanism is configured to selectively position the detent mechanism into and out of engagement with the switch so that activation of the switch by the detent mechanism occurs with the mode selector in the electronic firing mode position, wherein activation of the switch enables the electronic firing system so the pull of the trigger actuates the electronic actuator to fire the firearm.

2. The apparatus of claim 1, wherein the electronic firing system includes a second switch that is activated by a trigger lever engaged to the trigger to actuate the electronic actuator in response to the trigger being pulled and the selector mechanism being in the electronic firing mode position.

3. The apparatus of claim 1, wherein the selector mechanism is configured so that the switch is not activated by the detent mechanism in response to the selector mechanism being in any of the safety mode position, the semi-automatic firing mode position, and the automatic firing mode position.

4. The apparatus of claim 3, wherein in the electronic firing mode position the selector mechanism displaces the detent mechanism to activate the switch which enables operation of the electronic firing system.

5. The apparatus of claim 1, wherein the selector mechanism includes a post portion extending from the mode selector and a cam region at an end of the post portion that is opposite the mode selector, wherein the cam region defines a first cam location corresponding to the safety mode position, a second cam location corresponding to the semi-automatic firing mode position, a third cam location corresponding to the automatic firing mode position, and a fourth cam location corresponding to the electronic firing mode position, wherein each of the first, second, third and fourth cam locations is formed by a recess in the post portion.

6. An apparatus for a selective fire firearm, comprising:

an electronic firing system including an electronic actuator that actuates to fire the firearm in response to the electronic firing system being enabled and a pull of a trigger of the firearm;

a rotatable selector mechanism including an operating mode selector and a post portion extending from the operating mode selector, the post portion including an auto sear positioning portion for enabling at least one of automatic and semi-automatic firing of the firearm, a sear assembly blocking portion for preventing firing of the firearm, and an outer cam region engageable with the electronic firing system to selectively enable and disable the electronic firing system; and a detent mechanism engaged to the selector mechanism, wherein the selector mechanism is configured to selectively position the detent mechanism into and out of engagement with a switch so that activation of the switch by the detent mechanism occurs in response to a predetermined position of the outer cam region of the mode selector relative to the detent mechanism, wherein activation of the switch enables the electronic firing system to fire the firearm in response to the pull of the trigger.

7. The apparatus of claim 6, wherein the electronic firing system includes a second switch that is activated by a trigger lever engaged to the trigger to actuate the electronic actuator in response to the trigger being pulled and the switch being activated by the detent mechanism.

8. The apparatus of claim 6, wherein the selector mechanism is configured with a number of recesses around the outer cam region that each engage the detent mechanism to provide a positive stop at a corresponding location of the selector mechanism relative to the detent mechanism.

9. The apparatus of claim 8, wherein the outer cam region includes cam surfaces between the recesses and the detent mechanism rides along the cam surfaces between the recesses as the selector mechanism is rotated.

10. The apparatus of claim 6, wherein the outer cam region of the selector mechanism displaces the detent mechanism to activate the switch to enable operation of the electronic firing system.

11. The apparatus of claim 6, wherein the outer cam region defines a first cam location corresponding to a safety mode position, a second cam location corresponding to a semi-automatic firing mode position, a third cam location corresponding to an automatic firing mode position, and a fourth cam location corresponding to an electronic firing mode position, wherein each of the first, second, third and fourth cam locations is formed by a recess in the post portion.

12. An apparatus for a selective fire firearm, comprising:

a trigger;

a hammer connected to the trigger that is movable between a cocked position and an uncocked position;

a sear assembly and an auto sear that are each positionable to releasably engage the hammer;

an electronic firing system including an electronic actuator; and a selector mechanism including a mode selector movable between a safety mode position wherein the sear assembly is blocked from movement by the selector mechanism, a semi-automatic firing mode position wherein an upper sear and a lower sear of the sear assembly are movable relative to the selector mechanism to engage the hammer in the cocked position, an automatic firing mode position wherein the selector mechanism blocks movement of the upper sear and the auto sear is positioned by the selector mechanism to temporarily engage the hammer in the cocked position, and an electronic firing mode position in which the electronic firing system is enabled so a pull of the trigger actuates the electronic actuator to move the lower sear to release the hammer from the cocked position and the upper sear and lower sear are movable relative to the selector mechanism to engage the hammer in the cocked position.

13. The apparatus of claim 12, wherein the electronic firing system includes a first switch that actuates the electronic actuator in response to the trigger being pulled with the selector mechanism in the electronic firing mode position.

14. The apparatus of claim 13, further comprising a second switch and a detent mechanism engaged to the selector mechanism and the second switch, wherein in the electronic firing mode position the selector mechanism displaces the detent mechanism to activate the second switch which enables operation of the electronic firing system.

15. The apparatus of claim 14, wherein the selector mechanism is configured so that the second switch is not activated by the detent mechanism when the selector mechanism is in the safety mode position, the semi-automatic firing mode position, and the automatic firing mode position.

16. The apparatus of claim 12, wherein the selector mechanism includes a post portion extending from the mode selector and a cam region at an end of the post portion that is opposite the mode selector, wherein the cam region defines a first cam location corresponding to the safety mode position, a second cam location corresponding to the semi-automatic firing mode position, a third cam location corresponding to the automatic firing mode position, and a fourth cam location corresponding to the electronic firing mode position, wherein each of the first, second, third and fourth cam locations is formed by a recess in the post portion.

17. The apparatus of claim 16, wherein the post portion of the selector mechanism includes an auto sear positioning portion adjacent the mode selector and a sear assembly blocking portion extending from the auto sear positioning portion.

18. The apparatus of claim 17, wherein the auto sear includes an arm extending along the auto sear positioning portion in contact therewith, the auto sear positioning portion including a cylindrical first outer surface region and a second outer surface region that interrupts the cylindrical first outer surface region, wherein the arm of the auto sear is in contact with the first outer surface region in the safety mode position, the semi-automatic firing mode position, and the electronic firing mode position, and further wherein the arm of the auto sear is in contact with the second outer surface region in the automatic firing mode position which is configured to allow the auto sear to pivot toward the hammer for temporary engagement of the hammer with the auto sear in the automatic firing mode.

19. The apparatus of claim 17, wherein the sear assembly blocking portion includes a cylindrically shape body portion with a recessed surface on a first side of the cylindrically shaped body portion and a first notch and a second notch on an opposite side of the cylindrically shaped body portion.

* * * * *